US006254485B1

(12) United States Patent
Kanagawa et al.

(10) Patent No.: US 6,254,485 B1
(45) Date of Patent: Jul. 3, 2001

(54) GAME DEVICE USING A MOVING LIGHT AND REFLECTIVE PADDLE

(75) Inventors: Kazutsugi Kanagawa; Hideyasu Karasawa, both of Bunkyo-ku; Norihito Yamanaka, Bunkyo-ky, all of (JP)

(73) Assignee: Tiger Electronics, Ltd., Pawtucket, RI (US)

( * ) Notice: Subject to any disclaimer, the term of this patent is extended or adjusted under 35 U.S.C. 154(b) by 0 days.

(21) Appl. No.: 09/311,077

(22) Filed: May 13, 1999

(51) Int. Cl.[7] ..... A63F 7/06
(52) U.S. Cl. ..... 463/51; 463/3
(58) Field of Search ..... 463/1–5, 7, 30, 463/36, 47, 49–53; 273/371, 108.1, 237, 448, 459–461, 317, 317.1–317.9

(56) References Cited

U.S. PATENT DOCUMENTS

| | | | | |
|---|---|---|---|---|
| 3,993,309 | * | 11/1976 | Morris et al. | 273/85 R |
| 4,363,484 | * | 12/1982 | Breslow | 273/85 G |
| 4,461,470 | | 7/1984 | Astroth et al. . | |
| 4,478,407 | | 10/1984 | Manabe . | |
| 4,527,980 | | 7/1985 | Miller . | |
| 4,580,782 | | 4/1986 | Ochi . | |
| 4,582,323 | | 4/1986 | Minkoff et al. . | |
| 4,592,554 | * | 6/1986 | Gilbertson | 273/312 |
| 4,710,129 | | 12/1987 | Newman et al. . | |
| 4,895,376 | | 1/1990 | Shiung-Fei . | |
| 5,145,182 | * | 9/1992 | Swift et al. | 273/238 |
| 5,554,033 | * | 9/1996 | Bizzi et al. | 434/247 |
| 5,846,086 | * | 12/1998 | Bizzi et al. | 434/247 |

* cited by examiner

*Primary Examiner*—Mark Sager
*Assistant Examiner*—John M Hotaling, II
(74) *Attorney, Agent, or Firm*—Fitch, Even, Tabin & Flannery

(57) ABSTRACT

To provide a game device utilizing light, which can carry out various operations by game players and utilizes lights and can play a game while keeping interest.

This game device is characterized by the fact that it includes light output parts (5*c*, 5*d*, and 13) that substantially irradiate a projection light for forming an image and a function light, having a function which can be detected by a prescribed detection means, in the same direction, function light detection means, in the same direction, function light detection means (SW2 and 13) that can detect the above-mentioned function light, irradiating direction change means (50, 51, and 14) that change the irradiating direction of the light from the above-mentioned light output part, and a control means (30) that controls the irradiating direction change operation of the above-mentioned irradiating direction change means in accordance with the amount of function light detected by the above-mentioned function light detection part; that the above-mentioned function light detection means (SW2 and 13) detect a reflected function light reflected when the above-mentioned function light contacts a reflection plane (10).

8 Claims, 32 Drawing Sheets

Fig. 24

TABLE 1: KIND OF SERVE

| LEVEL | VALUE OF THE FUNCTION LIGHT COUNTER | SPEED | KIND OF SERVE |
|---|---|---|---|
| 1 | — | 1 | LOW SPEED |
| 2,3 | 0~2 | — | FAULT |
| | 3~4 | 5 | HIGH SPEED |
| | 5 OR MORE | 1 | LOW SPEED |

Fig. 27

TABLE II: KIND OF BALL RETURN

| LEVEL | VALUE OF THE FUNCTION LIGHT COUNTER | KIND OF BALL RETURN |
|---|---|---|
| 1 | 0 | FAILURE |
| | 1 OR MORE | SUCESS (BALL RETURN SPEED SHOWN IN TABLE3) |
| 2,3 | 0 | FAILURE |
| | 1,2 | SUCESS MAXIMUM BALL RETURN SPEED: 5 |
| | 3 OR MORE | LOW SPEED (BALL RETURN SPEED SHOWN IN TABLE3) |

Fig. 28

TABLE III: CHANGE OF BALL RETURN SPEED

| LEVEL | VALUE OF THE FUNCTION LIGHT COUNTER | VALUE OF THE HIT COUNTER | SPEED |
|---|---|---|---|
| 1 | 1 OR MORE | 0-5<br>6-9<br>10-13<br>14 OR MORE | 1<br>2<br>3<br>4 |
| 2 | 3 OR MORE | 0-3<br>4-7<br>8-11<br>12 OR MORE | 1<br>2<br>3<br>4 |
| 3 | 3 OR MORE | 0-2<br>3-5<br>6-7<br>8 OR MORE | 1<br>2<br>3<br>4 |

GAME DEVICE USING A MOVING LIGHT AND REFLECTIVE PADDLE

FIELD OF THE INVENTION

The present invention pertains to a game device utilizing lights.

BACKGROUND OF THE INVENTION

As a conventional game device utilizing lights, a game device shoots at a moving target using a light gun, etc., and reports hitting of the target with the shot light to a player by various means.

Using such a game machine, the player plays a game by shooting at the target with the gun. However, the interest of the player is simply whether or not the target is shot. Therefore, it was difficult to maintain the interest of the player.

A first purpose of the present invention is to provide a game device utilizing lights, which can carry out various operations by a player and can be played with maintained interest.

A further purpose of the present invention is to provide a game device that can play a game which returns an image moving like a ball game involving returning of a ball.

SUMMARY OF THE INVENTION

The game device of a first embodiment of the present invention is characterized by the fact that it includes a light output part that substantially irradiates a projection light for forming an image and a function light, having a function which can be detected by a prescribed detection means, in the same direction, a function light detection means that can detect the above-mentioned function light, an irradiating direction change means that changes the irradiating direction of the light from the above-mentioned light output part, and a control means that controls the irradiating direction change operation of the above-mentioned irradiating direction change means in accordance with the amount of function light detected by the above-mentioned function light detection part; that the above-mentioned function light detection means detects function light reflected when the above-mentioned function light contacts a reflection plane.

The projection light in the present invention is a light that can form images, light points, bright spots which can be observed by the eyes of a player, and as a general example, a condensed visual light can be mentioned.

The function light in the present invention is a light having a function that can be detected by a detection means or sensor which can be assembled into the device, and any light may be adopted as long as the detection result generates certain information.

The projection light irradiated from the light output part furnished in the projection unit forms a bright image of light. The function light is also irradiated from the substantially same position as the image of the projection light.

The player can detect the position at which the function light is irradiated by observing the image of the projection light, even if the irradiation position of the function light cannot be found out.

The function light detection means detects reflected function light when the function light contacts a reflection plane.

The irradiating direction change means changes the irradiating direction of the light from the light output part. In the change of the irradiating direction, a method that directly changes the irradiating direction from the light source and a method that changes the reflecting direction of a mirror surface for reflecting light from the light source are mentioned.

The control means controls the irradiating direction change operation of the irradiating direction change means in accordance with the amount of function light detected by the function light detection means.

As mentioned above, in the game device of the present invention, since the control means changes the irradiating direction of the light from the light output part in accordance with the amount of function light detected by the function light detection means, the reflection plane can be quickly operated in accordance with a moving image by a player.

In a second embodiment of the present invention, the above-mentioned projection unit is equipped with a report means and the above-mentioned control means controls the report operation of the above-mentioned report means in accordance with the amount of function light detected by the above-mentioned function light detection part.

The information being provided by the report means corresponds to the amount of function light. Therefore, it corresponds to the control of the irradiating change of the light output part. Referring to voice, sound effects, auditory reports by other sounds, or visual reports using light as the medium, the player can play an operation game of the reflection plane.

In a third embodiment of the present invention, the above-mentioned projection light and the above-mentioned function light are different lights, and the above-mentioned light output part is equipped with a projection light output part and a function light output part.

Although the projection light and the function light are different lights, the output direction of the two lights must be substantially the same.

In a fourth embodiment of the present invention, the above mentioned function light is infrared light, and the above-mentioned function light output part is infrared light output part.

A preferable example as the function light is infrared light that has the most general function light output part and function light detection means.

In a fifth embodiment of the present invention, the above-mentioned infrared output part intermittently outputs the infrared light, and the above-mentioned function light detection part generates a detection signal each time it detects infrared light. The above-mentioned control means adopts the number of said detected signals as the amount of infrared light detected.

The control means can measure the amount of infrared light detected by counting the number of detected signals generated by the function light detection part.

In a sixth embodiment of the present invention, the above-mentioned projection light and the above-mentioned function light are the same light.

Even if the projection light forms an image, if it is an effective means, it can be used as function light, and in this case, the light output part outputs one kind of light.

As a specific example in which the projection light is the detection light that can be easily detected by a detection means, a laser beam can be mentioned.

A seventh embodiment of the present invention is characterized by the fact that the change of the irradiation direction from the above-mentioned light output part is substantially a reciprocating change in the front and rear directions.

With the change of the irradiating direction in the front and rear directions, similar to a ball game such as tennis and table tennis, a match type game with an opponent can be played.

An eighth embodiment of the present invention is characterized by the fact that changes of the above-mentioned light output part include changes in the horizontal direction.

If the irradiating direction is also horizontally changed, it is difficult for the player to predict the projection position, technical ability in moving the reflection plane is required, and interest in the game is increased.

A ninth embodiment of the present invention is characterized by the fact that the above-mentioned control means changes the above-mentioned irradiation direction at a preset speed in accordance with the amount of said function light detected when the above-mentioned irradiating direction is in a prescribed angle range.

The change rate of the irradiating direction is controlled in accordance with the amount of function light detected in an angle range of a specific irradiating direction, so that the operation of the reflection plane by the player increases in difficulty, thereby increasing interest in the game.

A tenth embodiment of the present invention is characterized by the fact that the above-mentioned function light output part intermittently outputs the function light at a prescribed number of times in the above-mentioned prescribed angle range and that the above-mentioned control means changes the above-mentioned irradiating direction at a preset speed in accordance with the amount of detected signal when the output of the above-mentioned function light reaches the above-mentioned prescribed number of times.

The change rate of the irradiating direction, in which the output times are made correspondent to the number of times of the detected signal from the function light detection means, can be set by setting the intermittent output of the detection light to a prescribed number of times.

An eleventh embodiment of the present invention is characterized by the fact that the above-mentioned control means stops the change of the above-mentioned irradiating direction when the amount of said detected signal is less than a set value.

When the amount of detected signal does not reach a set value, the victory and defeat can be set in a game by stopping the change of the irradiating direction.

A twelfth embodiment of the present invention is characterized by the fact that the above-mentioned control means is equipped with counters that increment the number of stops to the front and rear each time the change of the above-mentioned irradiating direction is stopped in the front and in the rear; that the result of a game constituted by the change of the irradiating direction is reported from the above-mentioned report means when any of the counters reaches a prescribed number.

As mentioned above, if the counter, which increments the number of stops in the front and rear irradiating directions and stores them, reaches a prescribed number, a match similar to a tennis match, for instance, can be carried out by reporting the result to the report means.

A thirteenth embodiment of the present invention is characterized by the fact that the above-mentioned control means starts a game constituted by the change of the above-mentioned irradiating direction when the above-mentioned function light is detected in the front or in the rear.

As mentioned above, when the initial detection of the function light is set as the start condition of the game, the game is started by the operation of the reflection plane by the player, so that the game can be started in a manner similar to a serve in a tennis, for instance.

A fourteenth embodiment of the present invention is characterized by the fact that the above-mentioned reflection plane is installed in a racket-shaped body.

The reflection plane of the player is easily operated by installing the reflection plane in the racket-shaped body, so that the state as a ball game is further improved.

A fifteenth embodiment of the present invention is characterized by the fact that the above-mentioned reflection plane is a recursive reflection plane.

If the reflection plane is a recursive reflection plane, since the light contacting the reflection plane is reflected toward the light source, the above-mentioned light output part and the function light detection means in the projection unit can be integrated as a unit.

A sixteenth embodiment of the present invention is characterized by the fact that it includes a support member that sets the irradiating direction of the above-mentioned light output part downward and holds said light output part at a prescribed height.

Since images, light points, or light spots can be formed on a prescribed surface by the irradiation of the projecting light from the top, the player can send the reflection plane toward the upper light source, so that the function light can be reliably reflected.

BRIEF DESCRIPTION OF THE FIGURES

FIG. 24 is a table showing the relationship between the value of the function light counter and the rotation speed of the motor.

FIG. 27 is a table showing the relationship between the value of the function light counter and the rotation speed of the motor.

FIG. 28 is a table showing the relationship among level, value of the hit counter, and rotation speed of the motor.

Figure 1:
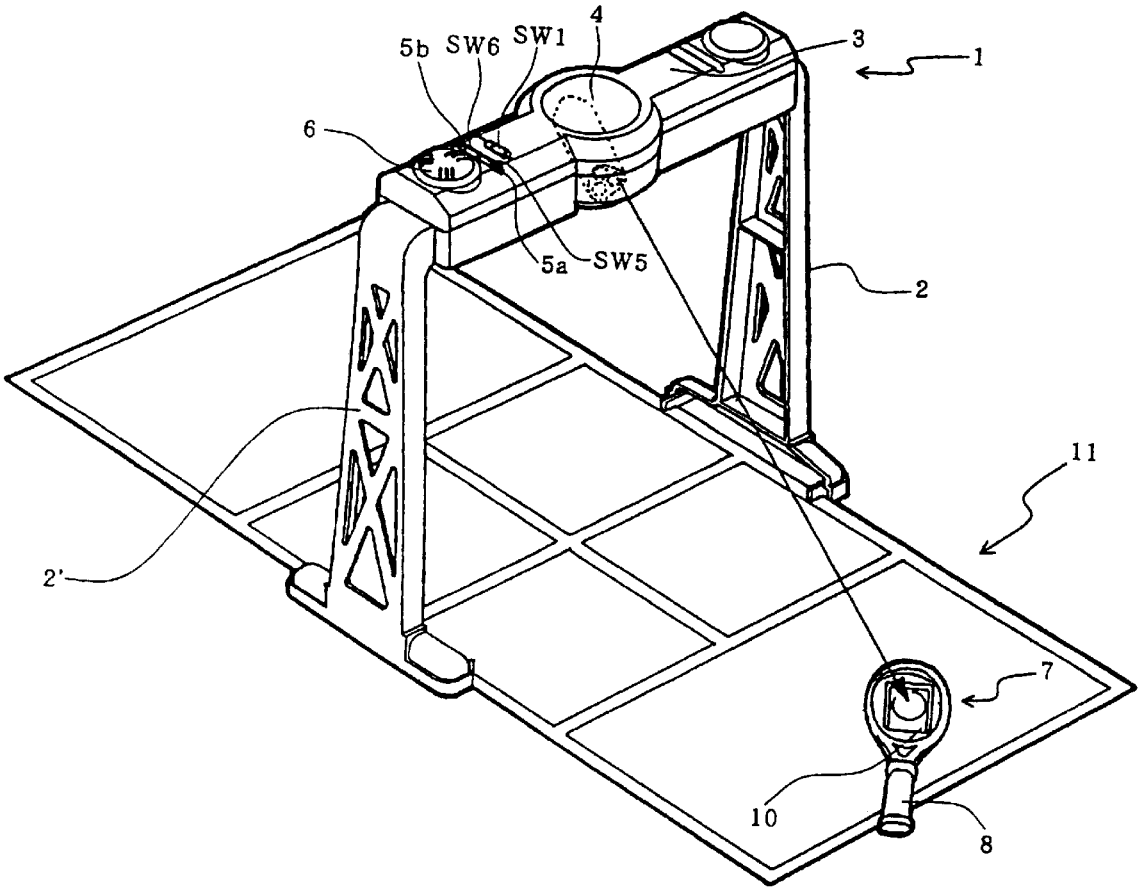
FIG. 1 is an external oblique view showing the game device of the application example of the present invention.

Explanation of Symbols:

1 Game device
2,2' Stands
3 Body
4 Circular enlarged part
5*a*,5*b* LEDs
5*c* Visible light output source
5*d* Function light output source
6 Speaker
7 Racket
8 Grip
9,9' Batteries
10 Reflection plane
11 Sheet
12 Movable unit
13 Projection unit
14 Driving unit
15*a* Upper housing
15*b* Intermediate housing
15*c* Lower housing
16 Motor
16*a*,20 Pinions
17,18 Reduction gears
19 Vertically long reduction gear
21,22,23 Gears
24 Function gear
25 Fan-shaped gear
26 Front and rear direction change gear
30 Microcomputer
31 CPU
32 I/O port
33 ROM
34 RAM
36 Clock source
42 P1 LED driving circuit
43 P2 LED driving circuit
44 Sound signal generating circuit
45 Visible light output source driving circuit
46 Function light output source driving circuit
47 Motor driving circuit
50 First arm member
51 Second arm member
52 Support member
53 Tubular member
54 Long plate member
55 Bearing member
56,57 Shafts
SW1 One-person game/two-person game decision switch
SW2 Function light sensor
SW3 Player 1 switch
SW4 Player 2 switch
SW5 Game select switch
SW6 Level select switch

DETAILED DESCRIPTION OF THE PREFERRED EMBODIMENTS

FIG. 1 is an oblique view showing an application example of the game device of the present invention.

The game device of the application example consists of projection unit 1, at least one racket 7, and perpendicularly long oblong sheet 11 for forming a court for a game.

The projection unit 1 consists of two bridge-shaped stands 2 and 2' arranged by interposing the sheet 11 so that the strands are located at the center of the longitudinal direction of the above-mentioned sheet 11 and a body 3 which is connected with the upper end of each stand 2 and 2' and horizontally held.

Figure 3:
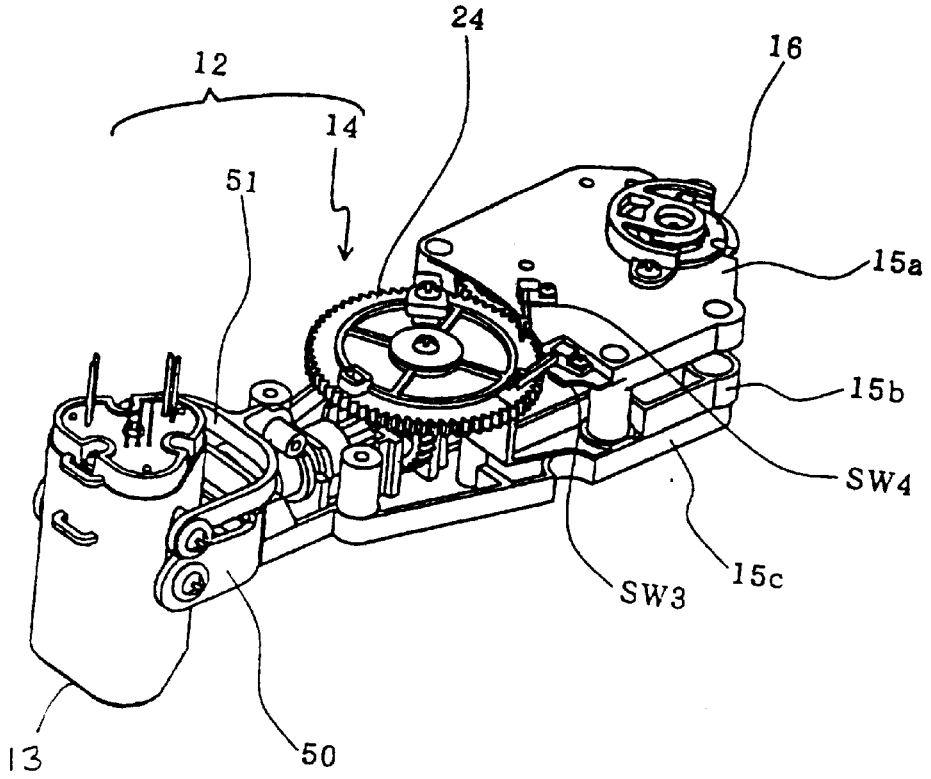
FIG. 3 is an oblique view showing a movable unit of the game device of FIG. 1.

At the center of the body 3, a circular enlarged part 4 is installed, and a projection unit 13 shown in FIG. 3 is arranged in it. A driving unit 14 for changing and driving the projection direction of the projection unit 13 is arranged at the inside position near the stand 2. The projection unit 13 and the driving unit 14 will be explained in detail.

Figure 2:
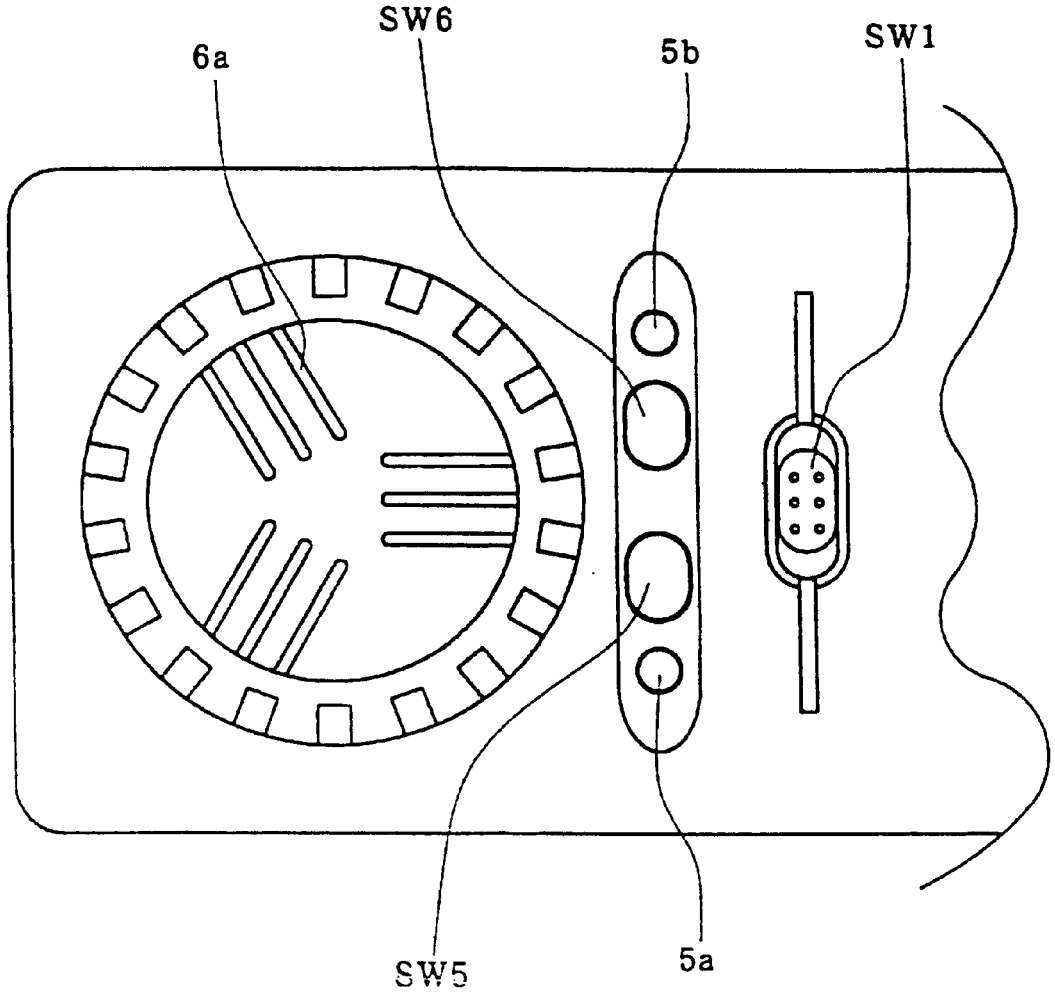
FIG. 2 is a partial plan view showing the main body of the game device of FIG. 1.

On the upper surface near the other stand 2', as shown in detail by a plan view of FIG. 2, one-person game/two-person game decision switch SW1, which is a power source switch controlled by moving back and forth by a player to select a one-person or 2-person game, game number select switch SW5, which can select the number of games of one match upon pressing by a player, and level select switch SW6, which can select the degree of difficulty upon similar pressing by a player, are arranged. The above-mentioned game number select switch SW5 and the level select switch SW6 are arranged in parallel in a row in front and in the rear along with a player 1 LED 5*a* for stimulating the play of a player 1 near the front of the game number select switch SW5 and a player 2 LED 5*b* for stimulating the play of a player 2 near the rear of the level select switch SW6.

A sound emission part 6*a* for sounds or voices being generated by a speaker 6 (FIGS. 16 and 17) is installed near the stand 2' at the position where the above-mentioned switches are installed.

In the position near the stand 2' of the body 3, furthermore, a battery box (not shown in the figure) for housing batteries B1 and B2 (FIG. 16), which are power sources, is installed, and an exchange port (not shown in the figure) for exchanging the batteries is installed on the bottom face. A lid (not shown in the figure), which is freely attached and detached, is installed.

At the inside position near the stand 2' of the body 3, furthermore, a circuit substrate, on which a control means that will be mentioned later, is mounted, is housed, and required wiring is attached.

The racket 7 is equipped with a grip 8 for gripping it by the hands of a player and a reflection plane 10 installed on the racket surface. The reflection plane 10 is a recursive reflection plane and has a function that reflects a light toward the light source if the light contacts it.

A tennis court-simulated line is drawn on the sheet 11.

Figure 4:
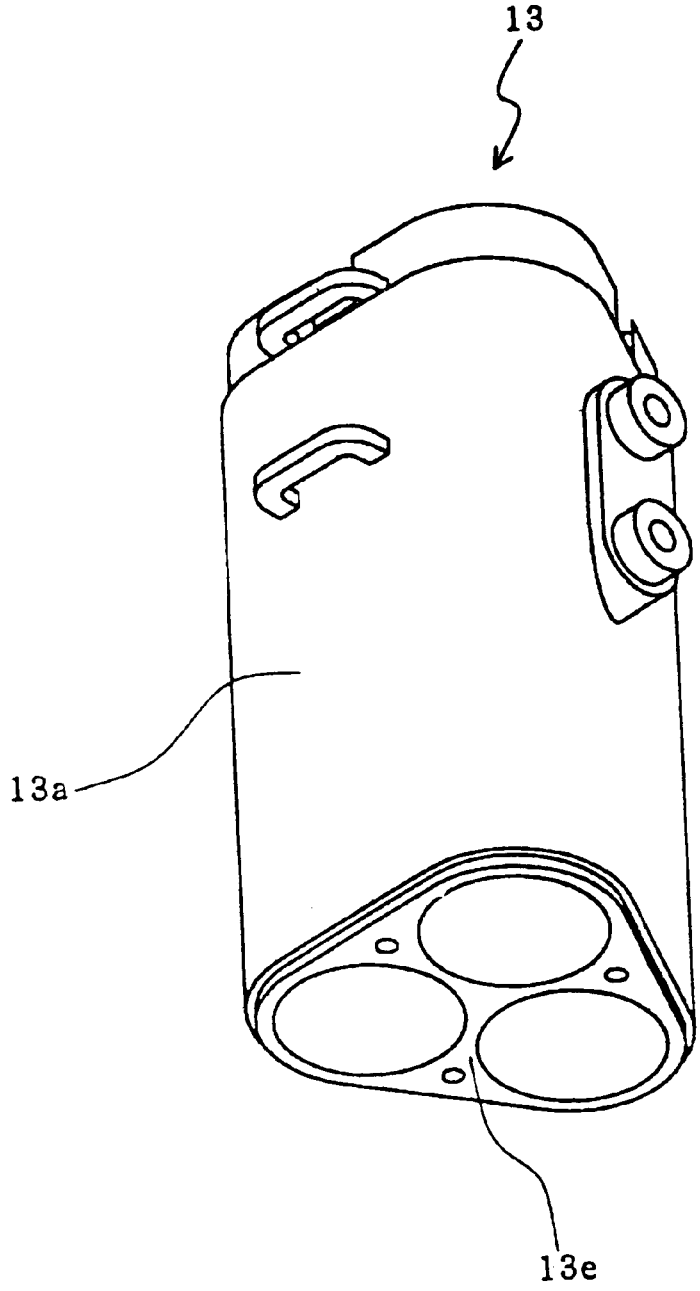
FIG. 4 is an oblique view showing a projection unit constituting the movable unit of FIG. 3.
Figure 5:
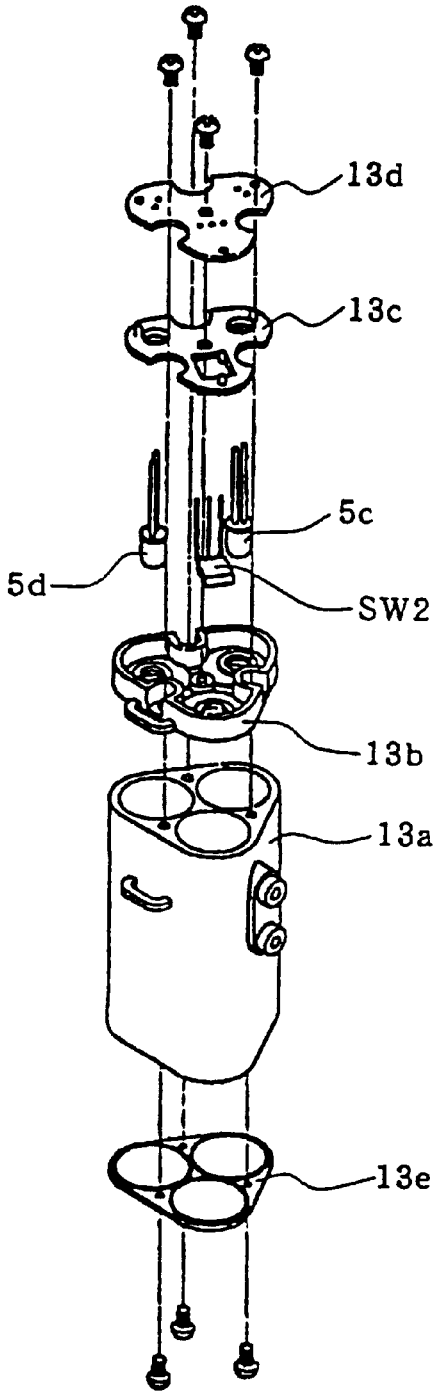
FIG. 5 is an oblique view showing constitutional members constituting the projection unit of FIG. 4.
Figure 6:
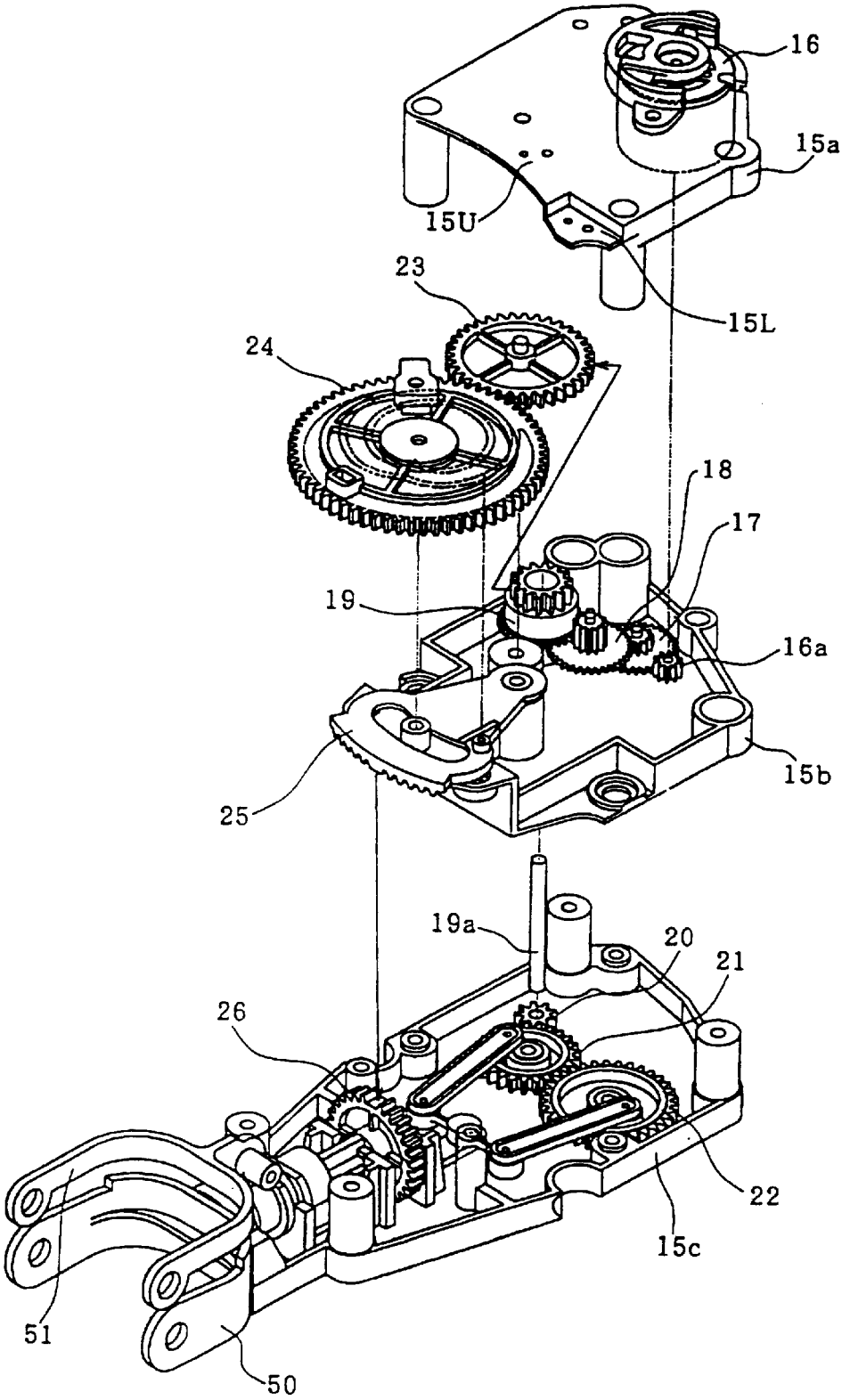
FIG. 6 is an oblique view showing constitutional members of the driving unit constituting the movable unit of FIG. 3.
Figure 7:
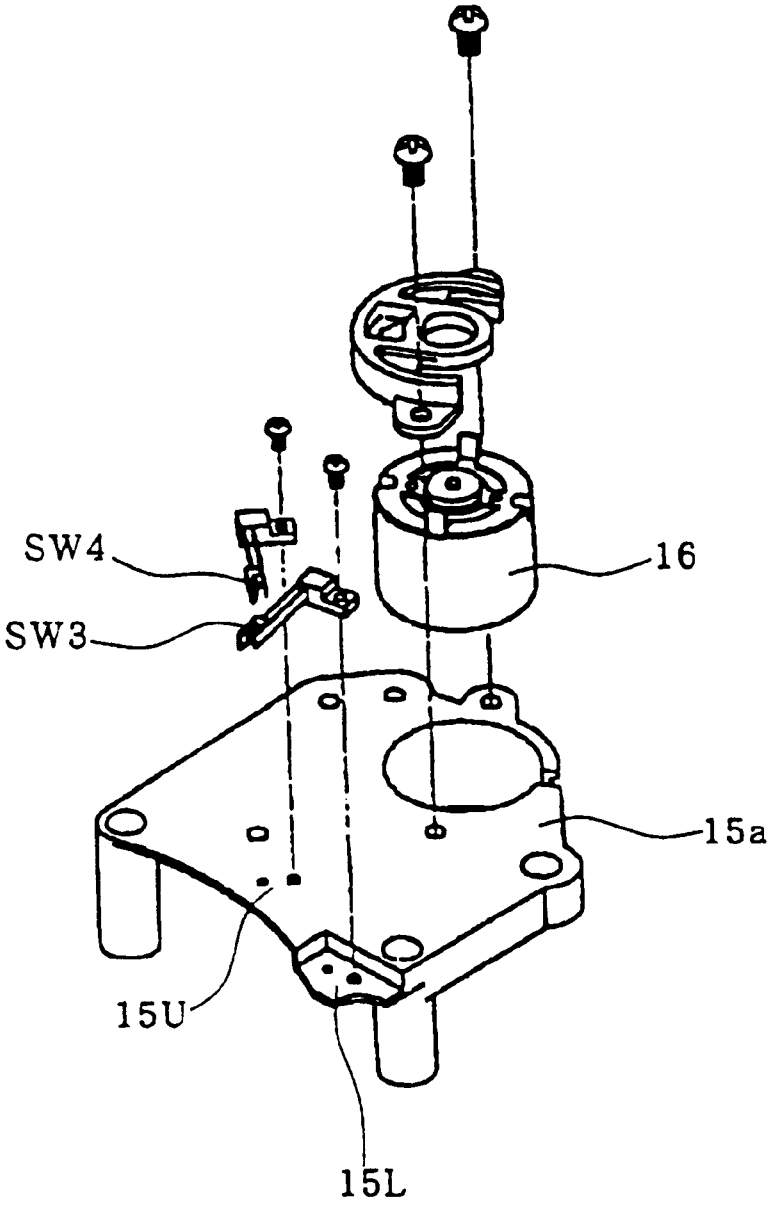
FIG. 7 is an oblique view showing constitutional members of the upper constitution of the driving unit of FIG. 6.
Figure 8:
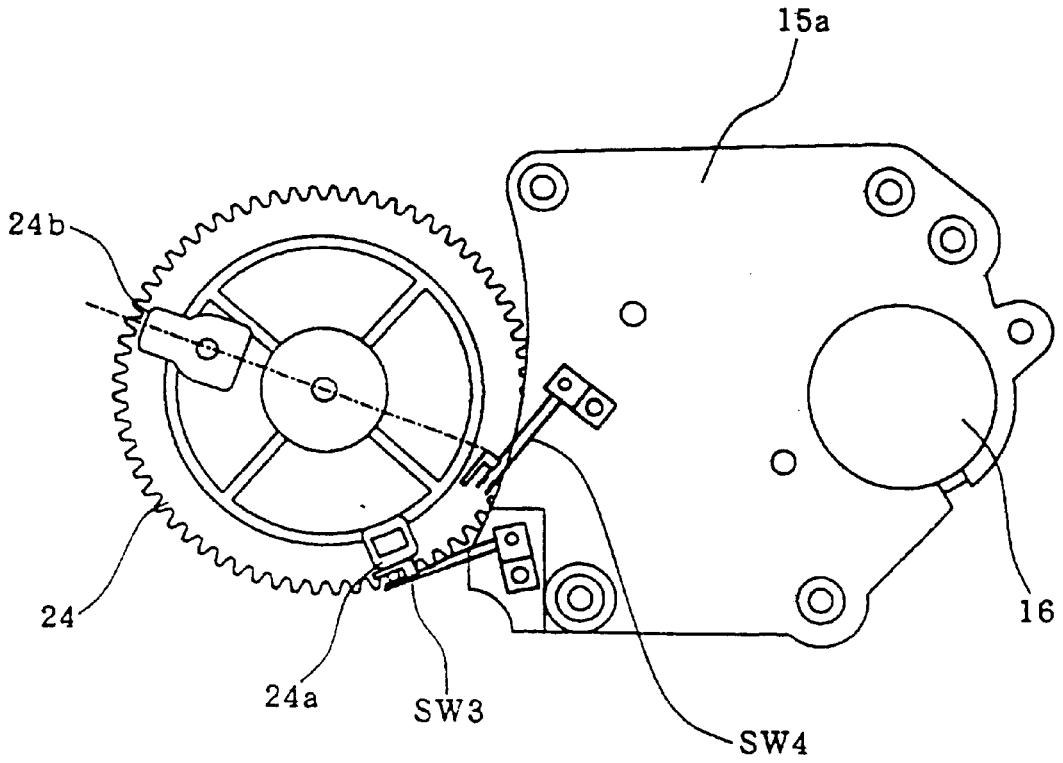
FIG. 8 is a plan view showing a function gear included in the upper constitution of FIG. 7 and the driving unit of FIG. 6.
Figure 9:
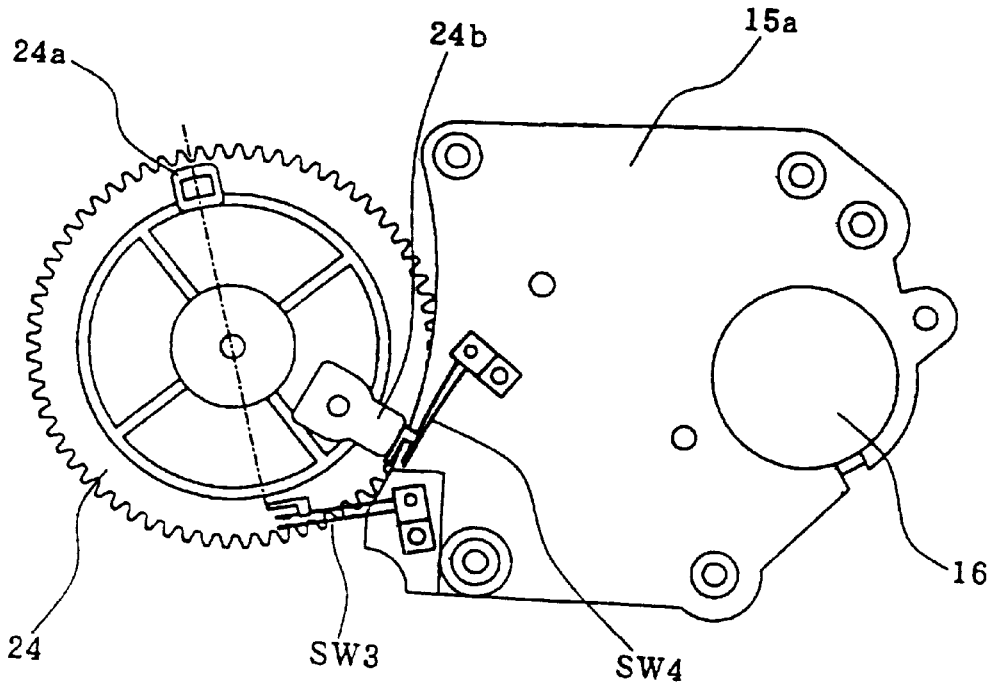
FIG. 9 is a plan view showing a function gear included in the upper constitution of FIG. 7 and the driving unit of FIG. 6.
Figure 10:
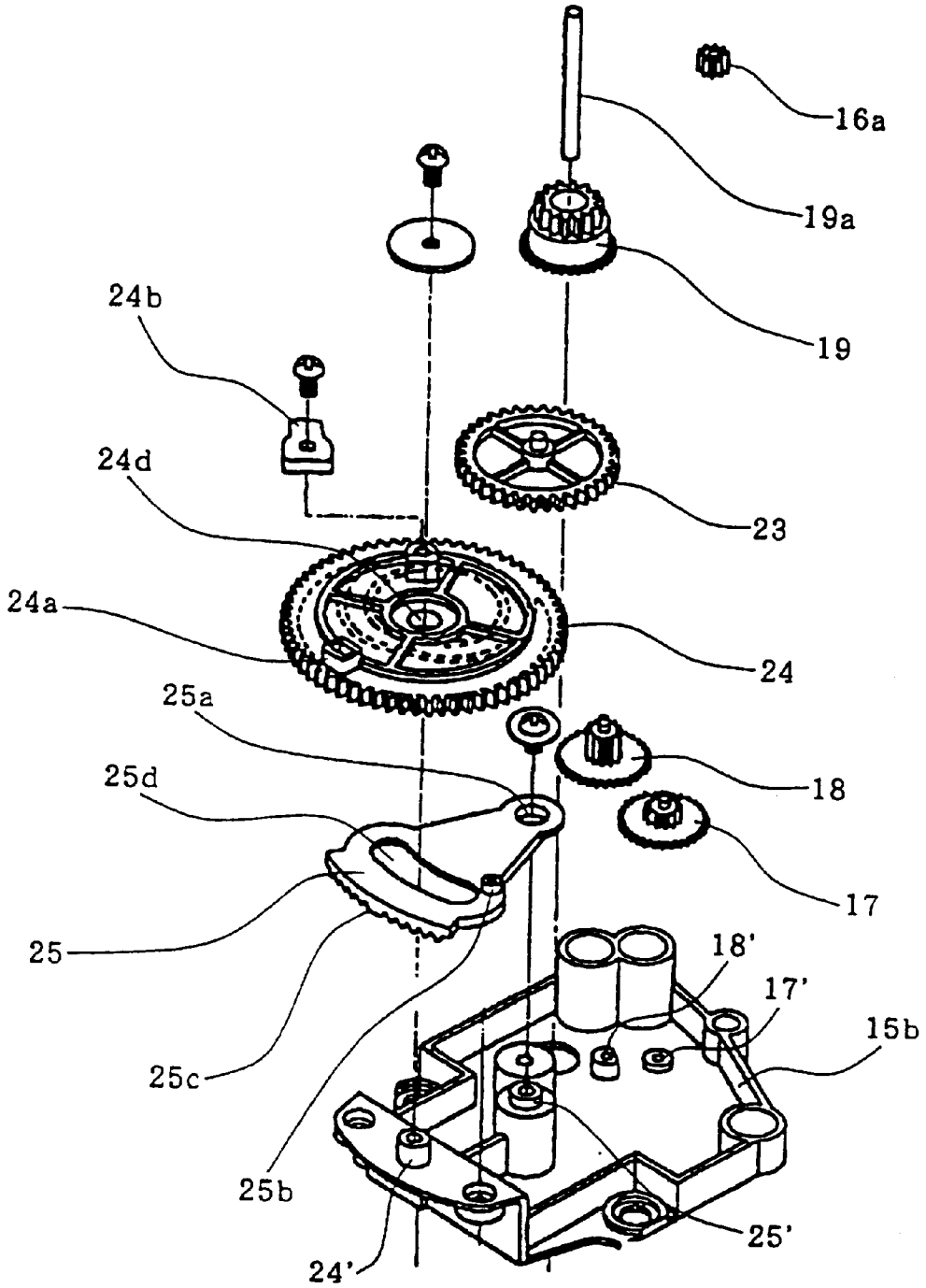
FIG. 10 is an oblique view showing constitutional members of the intermediate constitution of the driving unit of FIG. 6.
Figure 11:
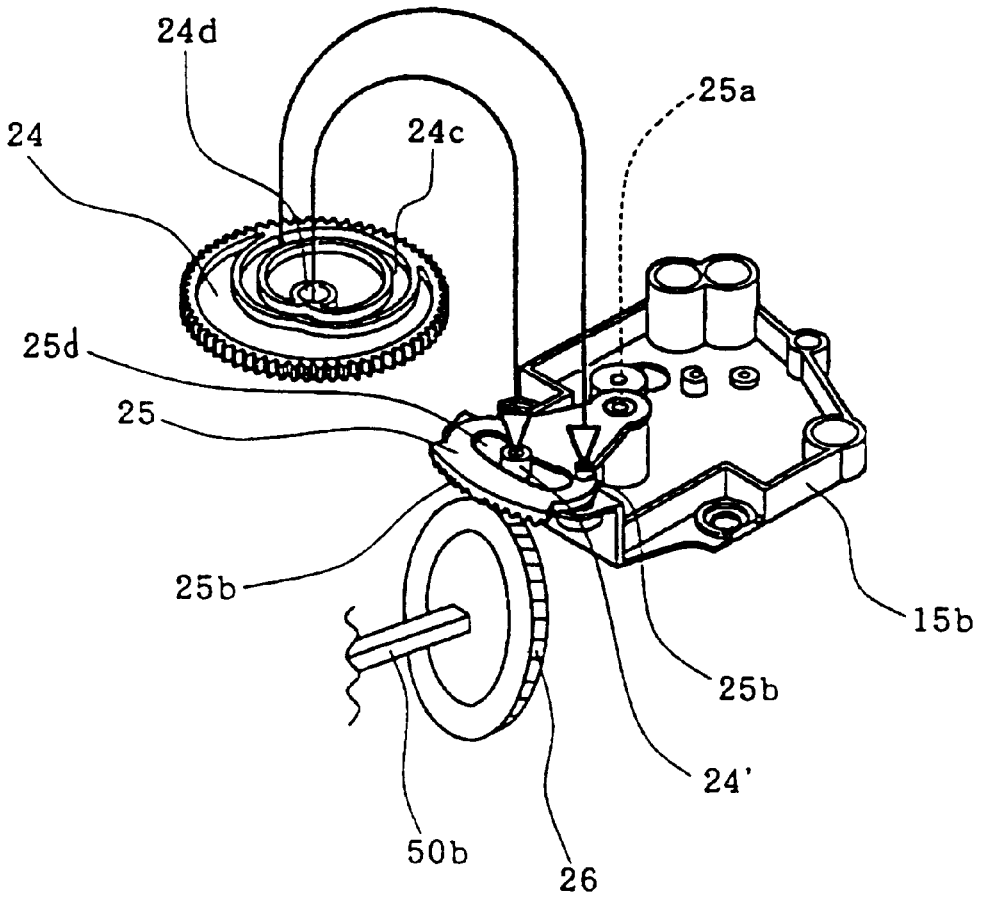
FIG. 11 is an oblique view showing the arrangement of gears in the intermediate constitution of FIG. 10 and the mesh of the front and rear direction change gear included in the driving unit of FIG. 6.
Figure 12:
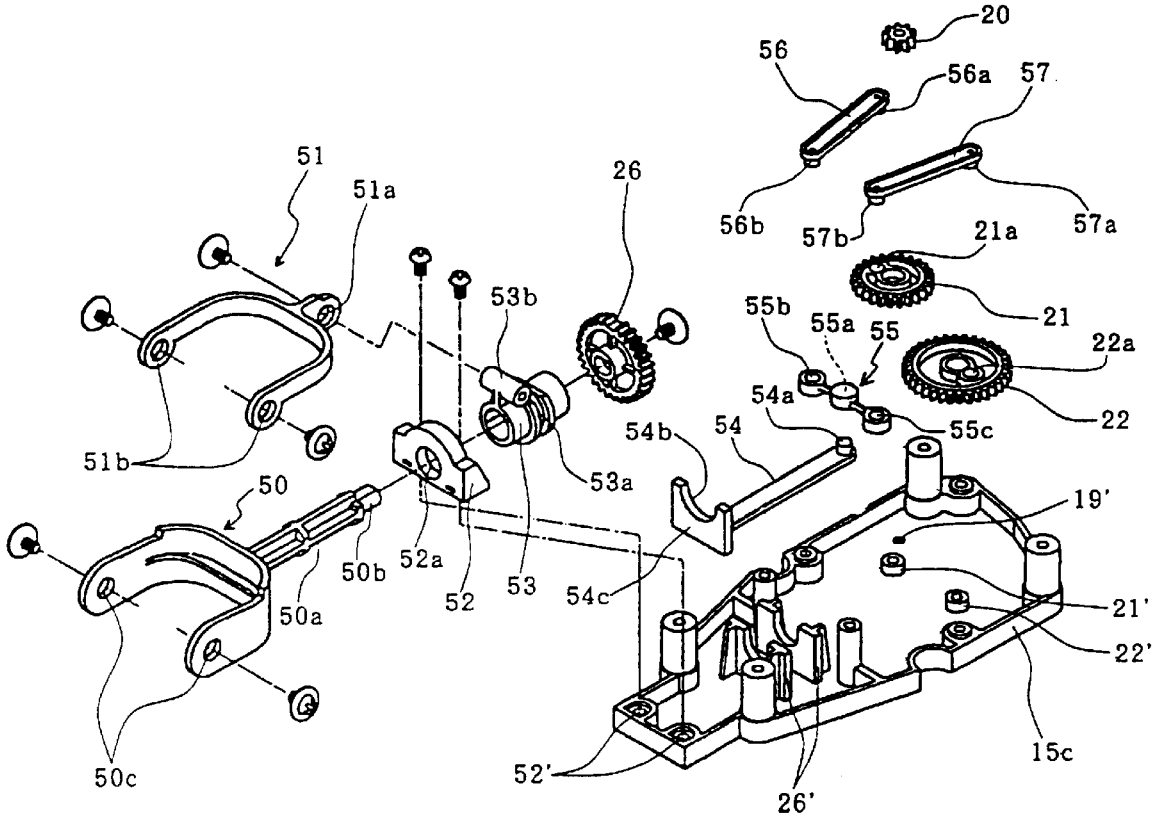
FIG. 12 is an oblique view showing constitutional members of the lower constitution of the driving unit of FIG. 6 and an arm member for holding the projection unit of FIG. 3.
Figure 13:
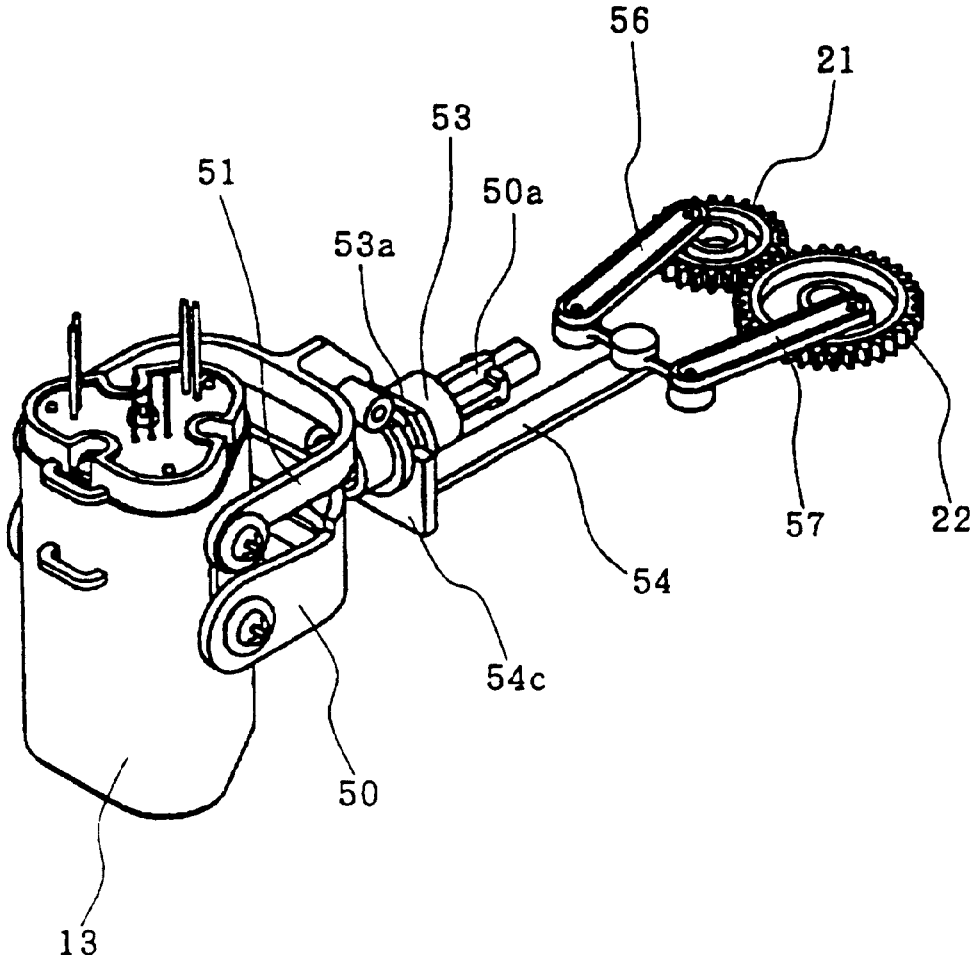
FIG. 13 is an oblique view showing a connection state of the arm member for holding the projection unit of FIG. 3 and gears included in the lower constitution of FIG. 12.
Figure 14:
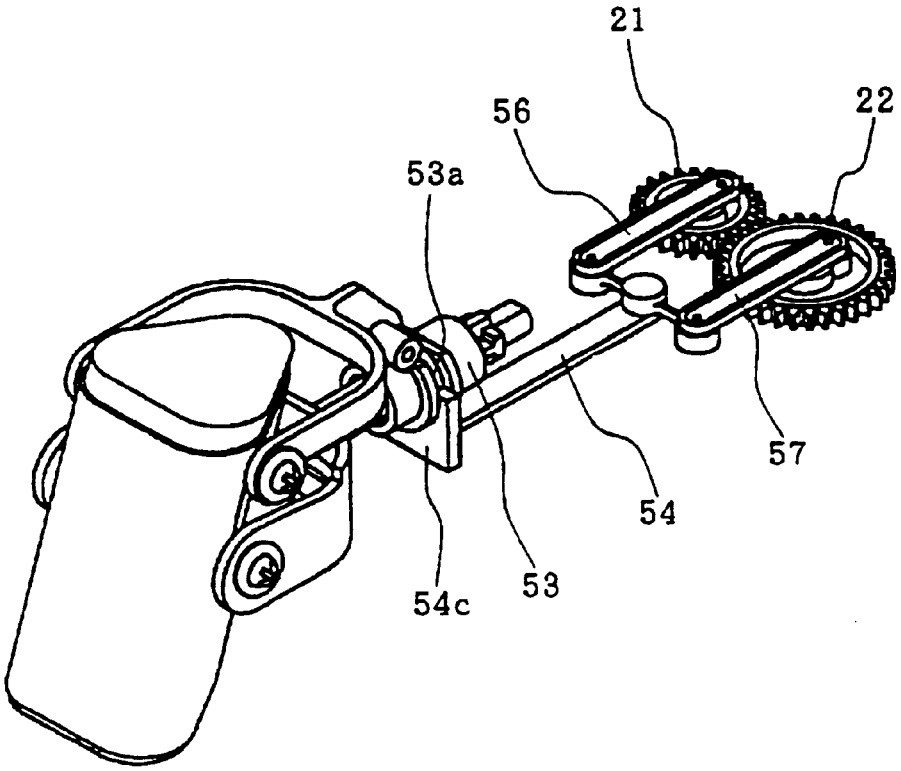
FIG. 14 is an oblique view showing a connection state of the arm member for holding the projection unit of FIG. 3 and gears included in the lower constitution of FIG. 12.
Figure 15:
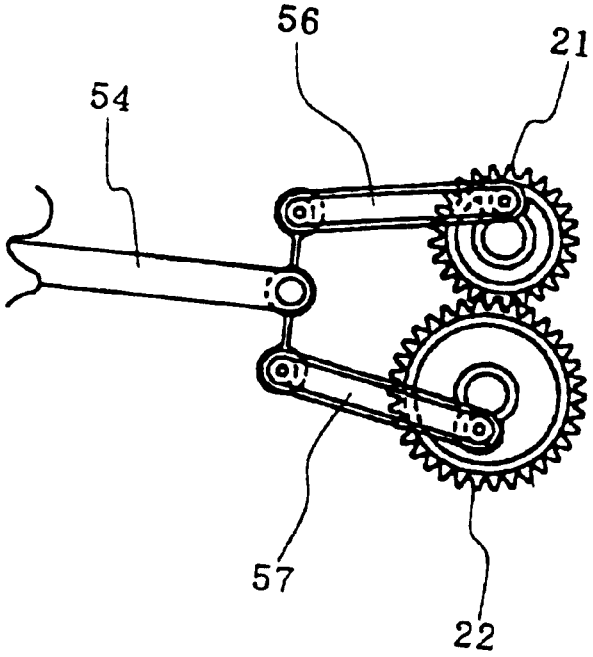
FIG. 15 is a partial plan view showing gears and the connecting member of FIG. 13.

FIG. 3 is an oblique view showing a movable unit 12 constituted by connecting the projection unit 13 with the driving unit 14 by two arm members 50 and 51. FIG. 4 is an oblique view observed from the lower side of the projection unit 13. FIG. 5 is an oblique view showing the constituent members of the projection unit 13. FIG. 6 is an oblique view showing a housing of a gear row included in the driving unit 14 with an upper constitution, intermediate constitution, and lower constitution. FIG. 7 is an oblique view showing the constituent members of the upper constitution of the driving unit 14. FIGS. 8 and 9 are plain view showing ON/OFF condition of the 2 switches included in the upper constitution. FIG. 10 is an oblique view of the constituent members of the intermediate constitution of the driving unit 14. FIG. 11 is an oblique view showing the driving mechanism included in the intermediate constitution. FIG. 12 is an oblique view of the constituent members of the lower constitution of the driving unit 14. FIG. 13 and 14 are oblique view showing the driving mechanism included in the lower constitution. FIG. 15 is its partial plain view.

The projection unit 13, as shown in FIG. 3, is connected to the driving unit 14 at the first arm member 50 and the second arm member 51.

The driving unit 14 is composed of a gear array arranged or stored in the upper housing 15*a*, the intermediate housing 15*b*, and the lower housing 15*c*, motor 16 that is a driving source which rotates and drives said gear array, and the player 1SW3 and player 2SW4 composed of leaf switches which turn ON/OFF by touching a protrusion set on the function gear in the aforementioned gear array.

The driving unit 14 enables the direction of the projection for the projection unit 13 to shift its movement forward and back and also shift its movement right and left as it draws an unpredictable path.

Signals generated by turning on and off player 1 switch SW3 or player 2 switch SW4, as will be mentioned later, are the reference information for driving a function light output source by the control means.

The projection unit 13, as shown in FIGS. 4 and 5, consists of vertically long tubular member 13*a* having a cavity corresponding to three vertically penetrating cylinders at equal angles, light source housing member 13*b* having three holes installed at the upper end of the tubular member at equal angles, super LED 5*c* which is a visible light output source being housed in the light source housing member 13*b*, infrared light LED 5*d* which is a function light output source, infrared sensor SW2 which is a function light sensor, two sheets of spacers 13*c* and 13*d* for stably fixing the above-mentioned LED 5*c* and 5*d* and the infrared sensor SW2, and lens plate 13*e* in which three circular convex lens installed at the lower end of the tubular member 13*a* are arranged at equal angles.

The visible light generated by the super LED 5*c* is condensed by the convex lens of the lower end through the cavity of the tubular member 13*a,* and the projection of a circular light is formed at a prescribed focal distance from the lower position (on the sheet 11 in this application example). On the other hand, the infrared light generated by the infrared light LED 5*d* is also condensed by the convex lens of the lower end through the cavity of the tubular member 13*a,* and the infrared light is projected at the same position as the projection position of the above-mentioned light.

Therefore, if the player has the reflection plane 10 of the racket 7 at the projection position of the visible light, the projection of the infrared light can also be reflected from the reflection plane 10 of the racket 7.

As mentioned above, the reflection plane 10 of the racket 7 is a recursive reflection plane. The infrared light contacting the reflection plane 10 is reflected in the light source direction, focused by the convex lens arranged in accordance with a tubular hole in which the above-mentioned infrared sensor SW2 is located, and arrives at the infrared light sensor SW2.

In the arrangement of the visible light output source, function light output source, and function light sensor, as mentioned above, it is considered that the projection position of the visible light and the projection position of the function light are consistent and that the reflected function light can arrive at the function light sensor.

The driving unit 14, as shown in FIG. 8, includes an upper constitution consisting of a motor 16 installed at the upper housing 15*a* and the player 1 switch SW3 and the player 2 switch SW4, which are leaf switches.

The player 1 switch SW3 is installed at a lower installation part 15L formed by installing a step in the upper housing 15*a*, and the player 2 switch SW4 is installed at an upper installation part 15U of the upper surface of the upper housing 15*a*.

On the other hand, a function gear 24 is arranged between the upper housing 15*a* and an intermediate housing 15*b*, and two projections 24*a* and 24*b* with different heights are installed on the upper surface of the function gear 24.

The low projection 24*a* of the function gear 24 contacts the player 1 switch SW3 installed at the lower installation part 15L of the upper housing 15*a* and can press it, and the high projection 24*b* of the gear 24 contacts the player 2 switch SW4 installed at the upper installation part 15U of the upper housing 15*a* and can press it.

As shown in FIG. 8, when player 1 switch SW3 contacts projection 24*a,* player 2 switch SW4 and projection 24*b* are positioned on the diameter line, and as shown in FIG. 9, when player 2 switch SW4 contacts projection 24*b*, player 1 switch SW3 and projection 24*a* are positioned on the diameter line. Therefore, the time interval between each switch SW3 and SW4 contacting each projection 24*a* and 24*b* and having pressed and having an ON signal generated is the same. Furthermore, since each projection 24*a* and 24*b* has a contact surface with a prescribed width, each switch SW3 and SW4 continuously generate the ON signal for a prescribed time.

The control means, which will be mentioned later, outputs the function light by driving the function light output source 5*d* if the above-mentioned ON signal is generated.

Next, the intermediate constitution arranged between the intermediate housing 15*b* and the upper housing 15*a* is explained.

As shown in FIG. 10, between the intermediate housing 15*b* and the upper housing 15*a*, a gear train consists of a pinion 16*a* installed on the rotation shaft of the motor 16, two reduction gears 17 and 18 that are arranged on shaft supports 17' and 18' that protrude from the upper surface of the intermediate housing 15*b* for reducing the rotation speed of the pinion 16*a*, a vertically long reduction gear 19 for further reducing the rotation speed of the reduction gear 18, a gear 23 meshed with the vertically long reduction gear 19, said function gear 24 meshed with the gear 23, and a fan-shaped gear 25 arranged at the lower side of the function gear 24.

In the above-mentioned fan-shaped gear 25, as shown in FIG. 10, an axial hole 25*a* installed in the circular part is inserted into a shaft 25' vertically installed on the housing 15*b* and locked with a screw via a washer and the gear can be freely rotated.

The fan-shaped gear 25 has projection 25*b* at one end and has a long hole 25*d* paralleling teeth 25*c* of the gear from the vicinity of the projection 25*b*.

The teeth 25*c* of the fan-shaped gear 25 are formed as part of a downward crown gear.

The function gear 24, as shown in FIG. 11, has heart-shaped groove 24*c*, and axial hole 24*d* enclosed by a tubular part is formed at the circular center part which is the position leading into the heart-shaped groove 24*c*.

A support shaft 24' formed at the housing 15*b* protrudes from the long hole 25*d* of the fan-shaped gear 25, and is inserted into the axial hole 24*d* of the above-mentioned function gear 24 is inserted [into 24'] and locked with a screw via a washer. At that time, the projection 25*b* of the above-mentioned fan-shaped gear 25 is inserted into the heart-shaped groove 24*c* of the lower surface of the function gear 24. The function gear 24 can freely rotate round support shaft 24', the support point.

The above-mentioned vertically long reduction gear 19 penetrates vertically into the circular center part and is fixed to an axial rod 19*a* reaching the lower side of the central housing 15*b*. A pinion 20, which will be mentioned later, is installed in the vicinity of the lower end of the axial rod 19*a*, and by this arrangement the rotation of the motor 16 is transferred to the lower constitution. The lower end of the axial rod 19*a* is inserted into a bearing hole 19' (FIG. 12) installed in the lower housing 15*c* such that it can be freely rotated.

The gear train constituted by the above-mentioned gears transfers rotation and reduces the rotation speed of the motor 16. If the function gear 24 rotates, the projection of the upper surface of the fan-shaped gear 25 moves along the heart-shaped groove 24*c* of the lower surface of the function gear 24, and the fan-shaped gear 25 reciprocates and rotates in the angle range of the long hole 25*d* round the shaft 24' as the support point.

The teeth 25*b* of the fan-shaped gear being reciprocated and rotated mesh with a front and rear direction change gear 26 (included in the lower constitution that will be mentioned later) fixed at the tip 50*b* of a shaft 50*a* protruded to the outside (to the right in FIG. 12) from the center of the above-mentioned first arm member 50 for inserting and holding the projection unit 13 by U-shaped upper arms, and the first arm member 50 is inclined about a prescribed angle, so that the projection direction of the projection unit 13 held by the first arm member 50 is reciprocated and varied in the front and rear direction as will be mentioned later.

Also, the shape of the first arm member 50 will be explained in detail later.

Next, the lower constitution arranged between the intermediate housing 15*b* and the lower housing 15*c* is explained.

As shown in FIG. 12, the train gear consisting of the pinion 20 installed in the vicinity of the lower end of the axial rod 19*a* fixed to the vertically long gear 19 rotated with the rotation of the motor 16, gear 21 meshed and rotated with the pinion 20, and gear 22 meshed and rotated, first arm member 50, the front and rear direction change gear 26 attached to the first arm member 50, and several members (shafts 56 and 57, bearing member 55, long plate member 54, tubular member 53, etc.) for transferring the movement generated by the rotation of the above-mentioned gears 21 and 22 to the first arm member 50 are arranged between intermediate housing 15*b* and the lower housing 15*c*.

The shaft 50*a* of the first arm member 50 penetrates into a throughhole 52*a* installed at the center of the support member 52 being locked with screws in screw holes 52' installed at one end of the lower housing 15*c*, and the front and rear direction change gear 26 installed on the tip of the shaft 50*a* is stably supported on two semicircular concave bearings 26' vertically installed on the upper surface of the lower housing 15*c* (FIG. 6).

The gears 21 and 22 are supported on bearings 21' and 22' installed at the lower housing 15*c* so that they can be respectively freely rotated.

Cylindrical bearings 21*a* and 22*a* are formed at eccentric positions on the upper surfaces of gears 21 and 22. Short shafts 56*a* and 57*a* installed at one end of two shafts 56 and 57 are respectively inserted into these cylindrical bearings 21*a* and 22*a*. At the other end of shafts 56 and 57, short shafts 56*b* and 57*b* are also installed.

On the upper surface of the lower housing 15*c*, the long plate member 54 is arranged so that it can be moved in the longitudinal direction. In the above-mentioned two bearings 26', a tunnel-shaped hole (not shown in the figure) for arranging the long plate member 54 is installed. The long plate member 54 has a short shaft 54*a* at one end.

In the bearing member 55 in which a bearing 55*a* fitted onto the short shaft 54*a* is formed at the center, two bearings 55*b* and 55*c* are formed on one straight line with interposed bearing 55*a*.

Short shafts 56*b* and 57*b* on the other ends of the above-mentioned shafts 56 and 57 are respectively inserted into bearings 55*b* and 55*c*.

At the other end of the long plate member 54, a vertical plate part 54*c* has a semicircular notch 54*b* installed in the upper part.

The notch 54*b* of the vertical plate part 54*c* is inserted into a groove 53*a* between two projections installed on the outer peripheral surface of the tubular member 53 that is inserted onto the shaft 50*a* protruded to the outside (to the right in FIG. 12) from the center of the above-mentioned first arm member 50 so that it can freely slide.

If the gears 21 and 22 are rotated, as shown in FIGS. 13–15, the shafts 56 and 57 integrated with the shafts 56*a* and 57*a* inserted into the cylindrical bearings 21*a* and 22*a* move. The number of teeth of gear 21 is smaller than the number of teeth of gear 22, and its radius is also shorter. Therefore, even if gear 21 is rotated once, gear 22 is not rotated once. The positions of shafts 56*a* and 57*a* of the shafts 56 and 57 are moved with the rotation of each gear 21 and 22. Along with it, the long plate member 54 is also horizontally moved, however the movement is complicated and irregular.

If the long plate member 54 is horizontally moved, the tubular member 53 is also horizontally moved along the shaft 50*a* of the first arm member 50.

The tubular member 53 is equipped with a shaft 53*b* perpendicular to the tube direction. In the shaft 53*b*, the axial hole 51*a* formed by penetration to the outside (to the right in FIG. 12) from the center of the second arm member 51 for inserting and holding the projection unit 13 by the U-shaped arm is inserted and locked with a screw. Therefore, if the tubular member 53 moves horizontally along the shaft 50*a* of the arm member 50, the second arm member 51 also moves.

As shown in FIGS. 13 and 14, the projection unit 13 is inserted and held by the U-shaped first arm 50. However as shown in FIG. 12, since the projection unit is locked with screws via washers in screw holes 50*c* which are installed in the vicinity of both ends of the arm so that the holes face the arm, the projection unit 13 can be freely horizontally rotated round the position locked with screws in first arm member 50 as a support point.

The arms of the above-mentioned second arm member 51 insert around projection unit 13 on the upper side of the arms of the above-mentioned first arm member 50 and lock onto it with screws via washers in screw holes 51*b* installed in the vicinity of each end of the arm so that the holes face the arm as shown in FIG. 12.

Thus, since the projection unit 13 is connected to the second arm member at its upper end while being held by the first arm member 50, if the second arm member 51 is moved along the shaft 50*a* of the first arm member 50 by the rotation of gears 21 and 22, the upper part of the projection unit 13 is pressed away or drawn to the second arm member 51 as the projection unit is horizontally rotated round the position held by first arm member 50 as a support point, so that the projection direction is horizontally changed.

As mentioned above, the above-mentioned front and rear direction change gear 26 is fixed at the tip 50*b* of the shaft 50*a* of the first arm member 50, and the shaft 50*a* of the first arm member 50 is rotated by the rotation of the fan-shaped gear 25 that meshes with the gear, so that the projection unit 13 held by the first arm member 50 is rotated in the front and rear direction.

Therefore, the projecting direction of the projection unit 13 is reciprocated and varied in the front and rear direction based on the movement of the first arm member 50 and the second arm member 51, and at the same time, it is also changed in the horizontal direction on a complicated track that cannot be predicted.

The gear row of the driving unit 14 is adjusted so that when the rotation of the above-mentioned first arm member arrives at a front prescribed position, an ON signal of the above-mentioned player 1 switch SW3 is generated and that when the rotation of the above-mentioned first arm member arrives at a rear prescribed position, an ON signal of the above-mentioned player 2 switch SW4 is generated.

Figure 16:
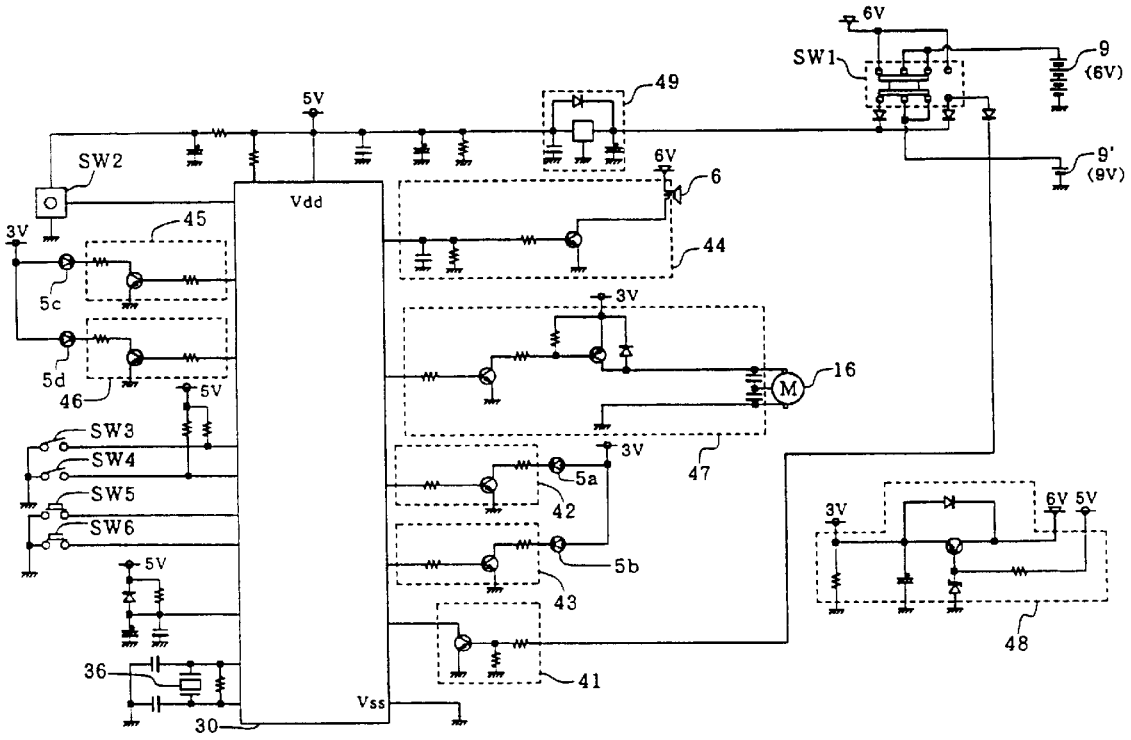
FIG. 16 is an electric circuit diagram showing the game toy of FIG. 1.
Figure 17:
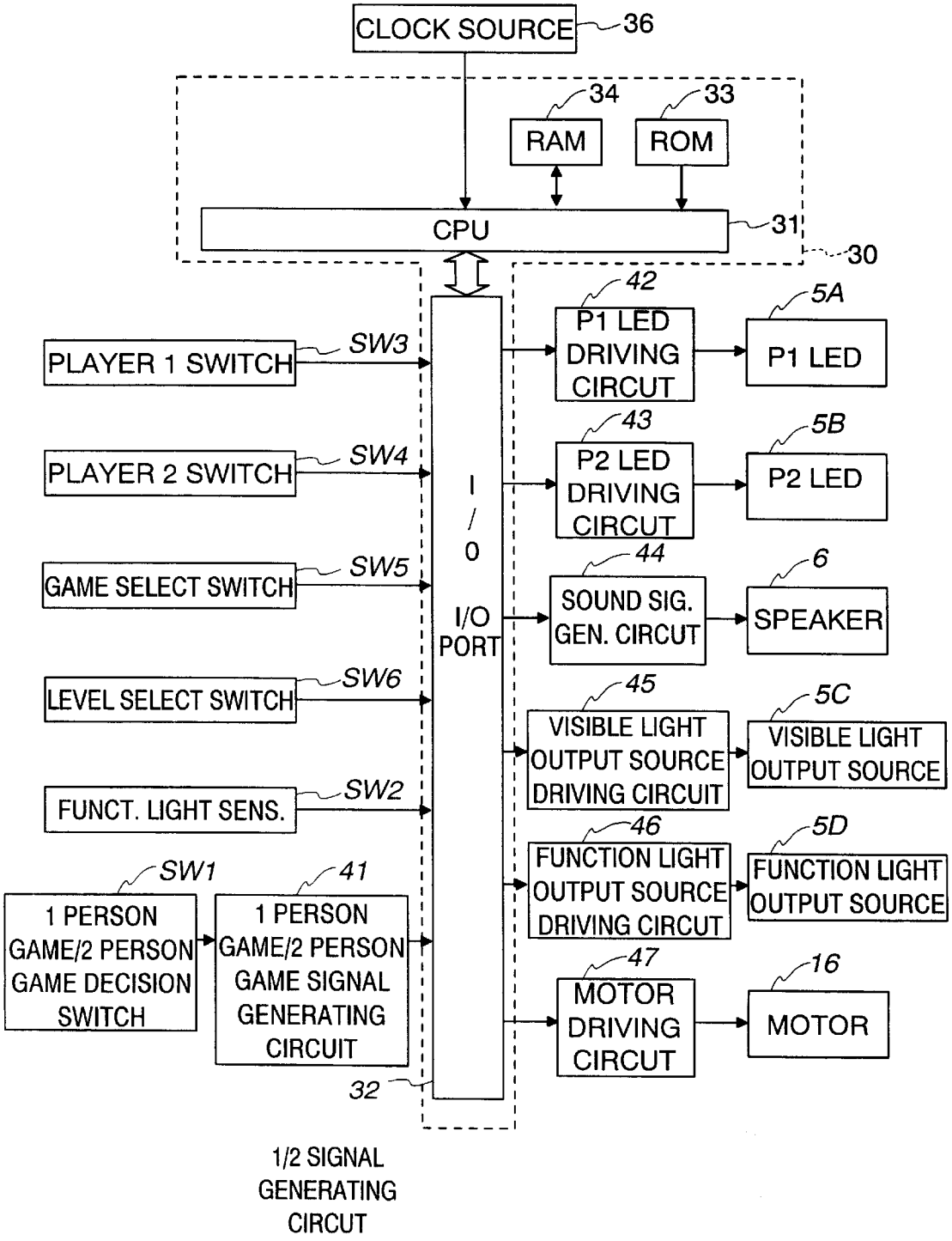
FIG. 17 is a block diagram of FIG. 16.

Next, the control means for controlling the operation of the projection unit 1 is explained based on the electric circuit diagram shown in FIG. 16 and the block diagram shown in FIG. 17.

As mentioned above, on the circuit substrate (not shown in the figure) housed in the inside near the stand 2' of the body 3, microcomputer 30 constituting the control means, motor driving circuit 47 for driving the motor 16, sound signal generating circuit 44 for driving the speaker 6, P1 LED driving circuit 42 for driving the player 1 LED 5*a*, P2 LED driving circuit 43 for driving the player 2 LED 5*b*, visible light output source driving circuit 45 for driving the visible light output source (super LED) 5*c*, function light output source driving circuit 46 for driving the function light output source (infrared light LED) 5*d*, one-person game/two-person game generating circuit 41, constant-voltage circuit 48 for converting the voltage of 9 V of the battery 9' into the voltage of 5 V, and constant-voltage circuit 49 for converting the voltage of 6 V of the battery 9 and the voltage of 5 V from the constant-voltage circuit 48 to the voltage of 3 v are mounted.

The operation of the projection unit 1 is controlled by the microcomputer (hereinafter, called a micom) 30. The micom 30 has central processing unit (CPU) 31, input and output (I/O) port 32 that is input with a signal from the above-mentioned signal generation means and outputs by CPU 31 a driving signal to several driving circuits related to the projection unit, read-only memory (ROM) 33 for storing a program for game processing by the CPU 31 and several data tables extracted and used to advance the game by the CPU 31, and random access memory (RAM) 34 that houses rewritable, renewable, or resettable game processing data at a time of game advance and continually renews random numbers used in game advance.

The above-mentioned signal generation means consists of a one-person game/two-person game signal generating circuit 41 that is the terminal in contact with the above-mentioned one-person game/two-person game decision switch SW1 and generates a one-person game signal or two-person game signal, function light sensor SW2, player 1 switch SW3, player 2 switch SW4, game times select switch SW5, and level select switch SW6.

The above-mentioned driving circuit consists of P1 LED driving circuit 42 for driving a P1 LED, P2 LED driving circuit 43 for driving a P2 LED, sound signal generating circuit 44 for generating a sound from the speaker, visible light output source driving circuit 45 for driving a visible light output source (super LED in this application example) for outputting a visible light that is the projection light, function light output source driving circuit 46 for driving a function light output source (infrared light emission LED in this application example) for outputting a function light (infrared light in this application example), and motor driving circuit 47 for driving a motor.

A clock source 36 is connected to the CPU 31.

In this application example, the RAM 34 is used as a random number renewal means being used in the advance of the above-mentioned game. However, a random number generator may also be housed in the micom 30 and used in the advance of the game.

As voice data stored in the ROM 33, "play," "fault," "double fault," "net," "out," "service change," "game player 1," "game player 2," "game set," "won player 1," "won player 2," game count call for two match players, which is the call voice of an umpire, "pon" (report of a service start), "poon" (report that a ball is hit at ordinary strength by a racket), "basshit" (report that a ball is smashed or hit strongly), "ton" (report that a ball is dropped in a court), "bassat" (report that a ball touches a net), which are sounds for reporting the state of the ball, fanfare sounds, regret sounds, cheering sounds, etc., which are effect sounds, report of set score, report of game score, etc., can be mentioned. The game sequence of the projection unit 1 with such a constitution is explained using flow charts, partial circuit diagrams, and tables showing reference values for selecting the driving speed of the motor housed in the ROM 33 in FIGS. 18–32.

Figure 18:
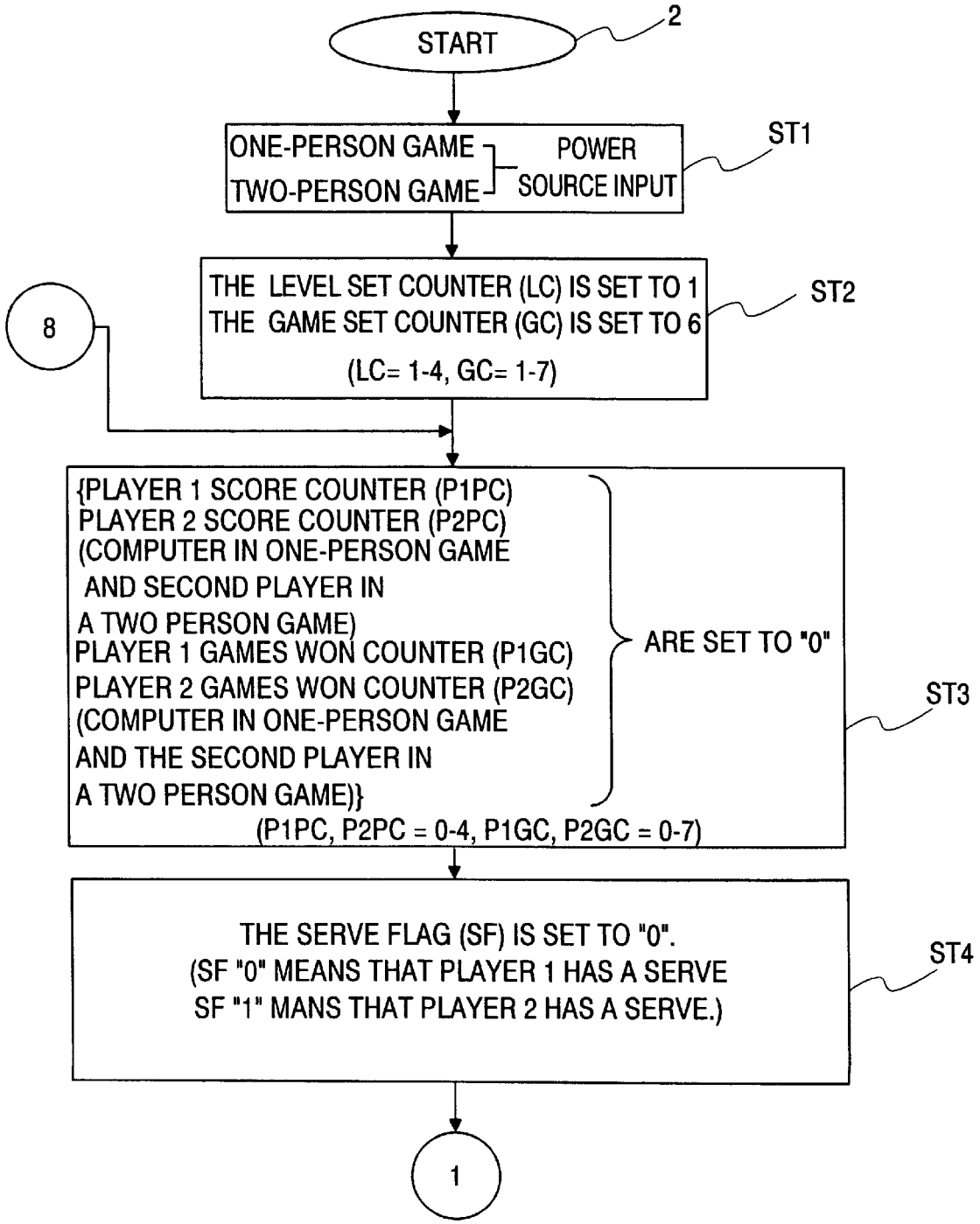
FIG. 18 is a flow chart showing the game sequence of the game device of FIG. 1.

As shown in the flow chart of FIG. 18, in order to operate the projection unit 1, the one person-game/two-person game decision switch SW1 is moved to the right or left from the central power source OFF position (step 1).

Figure 19:
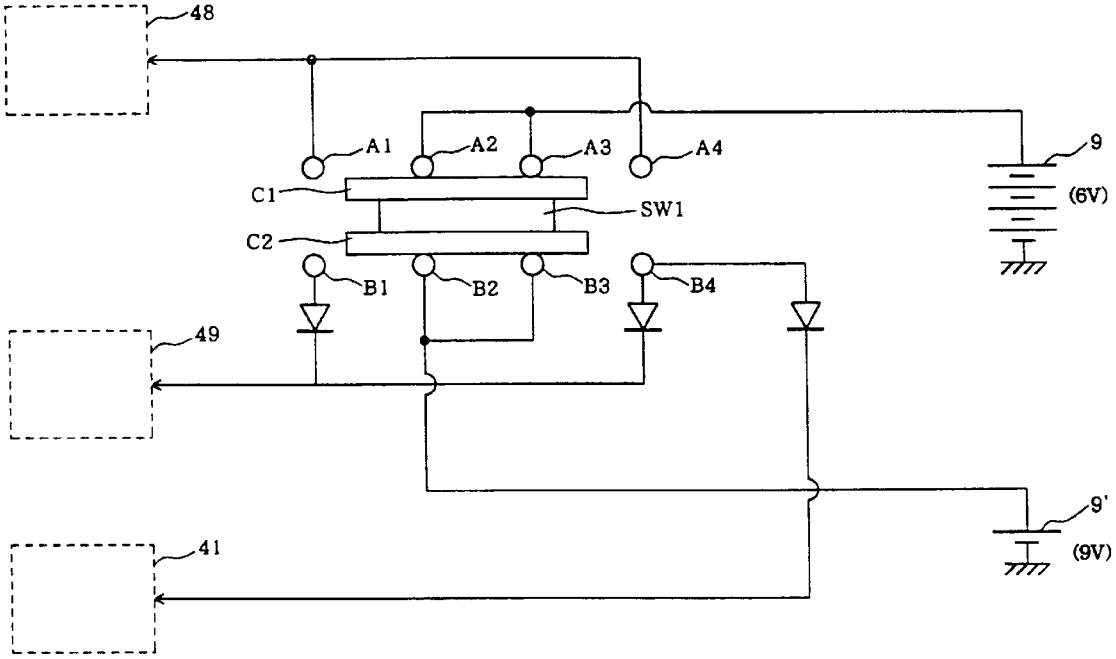
FIG. 19 is part of the circuit diagram of FIG. 17.
Figure 20:
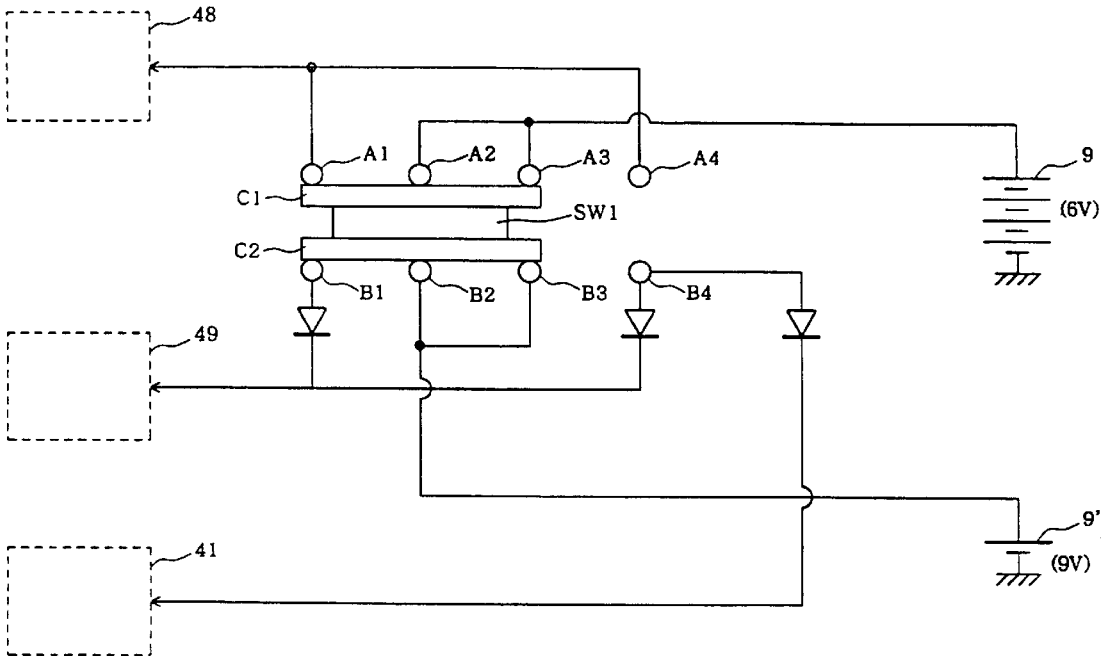
FIG. 20 is part of the circuit diagram of FIG. 17.
Figure 21:
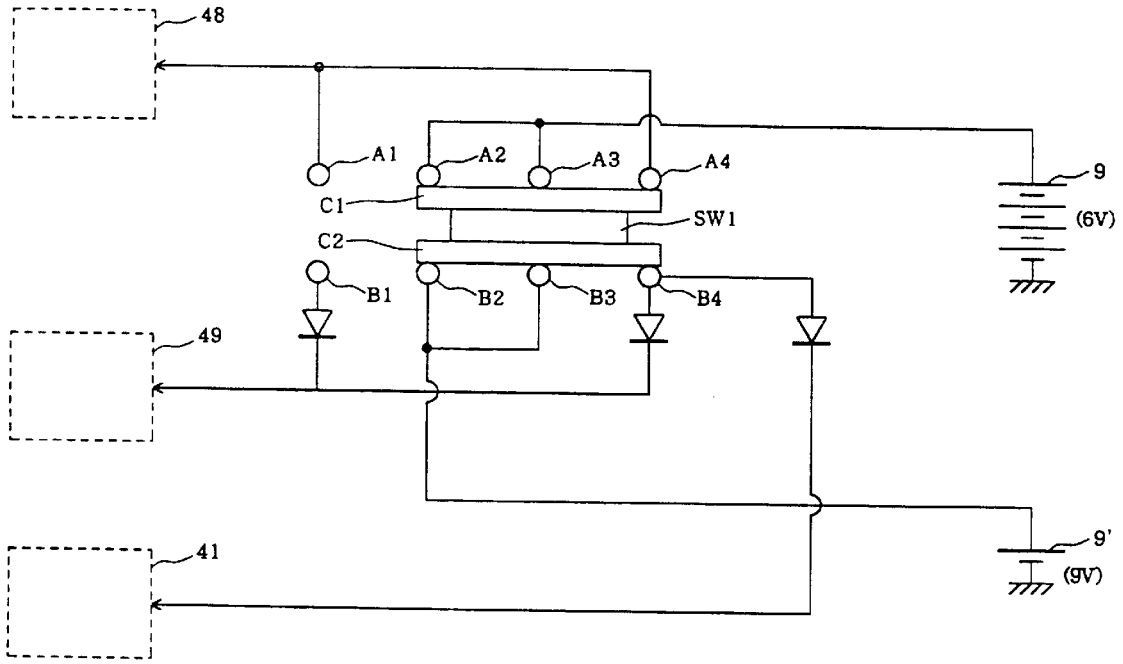
FIG. 21 is part of the circuit diagram of FIG. 17.

FIG. 19 is a partial circuit diagram showing a state in which the one-person game/two-person game decision switch SW1 is positioned at the center and the power source is turned off. FIG. 20 is a partial circuit diagram showing a state in which the one-person game/two-person game decision switch SW1 is positioned on the left and the one-person game/two-person game signal generating circuit 41 generates a one-person game signal. FIG. 21 is a partial circuit diagram showing a state in which the one-person game/two-person game decision switch SW1 is positioned on the right and the one-person game/two-person game signal generating circuit 41 generates a two-person game signal.

In the switch structure in which the one-person game/two-person game decision switch SW1 can be slid, four contacts A1, A2, A3, and A4 arranged in a row and contacts B1, B2, B3, and B4 arranged parallel with the above-mentioned row and facing each other, are installed. The switch SW1 has two sheets of electroconductive plate C1 and C2 running parallel with the longitudinal direction of an oblong moving member. The electroconductive plate C1 can contact the above-mentioned contacts A1, A2, A3, and A4, and the electroconductive plate C2 can contact the above-mentioned contacts B1, B2, B3, and B4.

The above-mentioned contacts A2 and A3 contact the battery 9. The above-mentioned contacts A1 and A4 contact the above-mentioned contact-voltage circuit 48 and speaker driving circuit 44 (FIG. 16). The above-mentioned contacts B2 and B3 are connected to the battery 9'. The above-mentioned contacts B1 and B4 are connected to the above-mentioned constant-voltage circuit 49, etc., and the contact B4 is further connected to the one-person game/two-person game signal generating circuit 41.

As shown in FIG. 19, when the above-mentioned switch SW1 is positioned at the center, the electroconductive plate C1 contacts the contacts A2 and A3, and the current from the battery 9 does not flow to the circuit 48. The electroconductive plate C2 contacts the contacts B2 and B3, and the current from the battery 9' does not flow to the circuit 49. Therefore, the power source is turned off.

As shown in FIG. 20, if the above-mentioned switch SW1 moves and the electroconductive plate C1 contacts the contacts A1, A2, and A3, the current from the battery 9 flows to the circuit 48. The electroconductive plate C2 contacts the contacts B1, B2, and B3, and the current from the battery 9' flows to the circuit 49. However, the current toward the one-person game/two-game person generating circuit 41 does not flow. In this state, the one-person game/two-person game signal generating circuit 41 generates a one-person game signal. Therefore, in FIG. 2, if the switch SW1 is moved to the front, the power source is turned on, and a one-person game is started.

As shown in FIG. 21, if the above-mentioned switch SW1 is moved and the electroconductive plate C1 contacts the contacts A2, A3, and A4, the current from the battery 9 flows to the circuit 48. The electroconductive plate C2 contacts the contacts B2, B3, and B4, and the current from the battery 9' flows to the circuit 49. The current also flows to the one-person game/two-person game signal generating circuit 41. In this state, the one-person game/two-person game generating circuit 41 generates a two-person game signal. Therefore, in FIG. 2, if the switch SW1 is moved to the rear, the power source is turned on, and a two-person game is started.

Thus, the player can select the one-person game or two-person game when a power source is input into the projection unit 1.

The CPU 31 sets level set counter (LC) to 1 and game number set counter (GC) to 6 (step 2). With the setup of the LC to 1, the slowest speed state of change of the light-projecting direction is changed to a game state in which a game is started, and with the setup of the game number set counter at 6, a match with a six-game score, which is the most typical number of games in a tennis match and used in this application example, is set. Thus, if the power source of the game device 1 is input, the level set counter is always 1, and the game number set counter is 6.

The CPU 31 further sets player 1 score counter (P1PC), player 2 (a computer that is the match opponent in the one-person game, and the second player in the two-person game) score counter (P2PC), player 1 games won counter (P1GC), player 2 (a computer that is the match opponent in the one-person game, and the second player in the two-person game) games won counter (P2GC) to 0 (step 3). These counters, as will be mentioned later, are increased with the progress of the game, and even when the power source is turned off, the values of the counters remain. When the match starts, the counters are reset to 0.

The CPU 31 sets a serve flag (SF) to "0" (step 4). The serve flag means that when the flag is "0", player 1 has serve and that when the flag is "1," the computer (in the one-person game), which is the player 2, or the second player (in the two-person game) has serve. At the initial stage of the match in which the power source is input, the serve flag is always set to "0" so that the player 1 has the serve.

The above operation is carried out by the CPU 31 when the power source is input into toy 1, and in this state, all the counters are reset.

Figure 22:
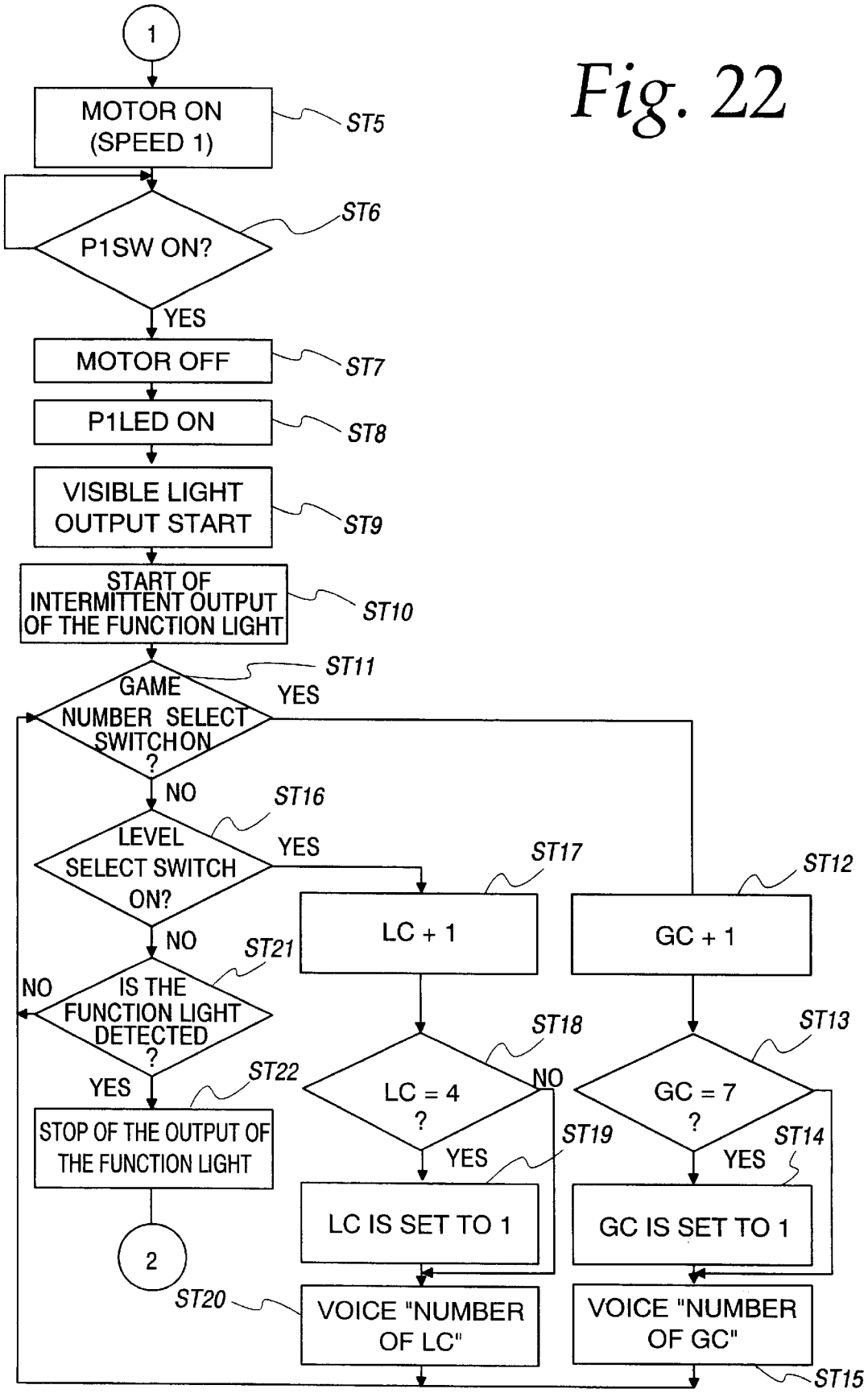
FIG. 22 is a flow chart showing the game sequence of the game device of FIG. 1.

Next, the game start sequence shown in FIG. 22 is explained.

In the state in which all the counters are reset, the CPU 31 drives the motor at speed 1 (step 5) and determines whether or not the P1 switch (SW3) generates an ON signal (step 6).

If a cam presses the P1 switch SW3 from driving the motor and the P1 switch SW3 generates the ON signal, the CPU 31 stops the rotation of the motor 16 (step 7), emits the P1 LED 5*a* (step 8), and emits the super LED 5*c* which is visible light (step 9). The projection position of the light of the super LED 5*c* is stopped on the side of the player 1 by the stopping of motor 16 of step 7. In this application example, the projection of a circular bright light with a size similar to a tennis ball is formed on the game surface (FIG. 1). The CPU 31 lights the P1 LED 5*a* to report that the player 1 is a game player who strikes back the projection of the light.

Furthermore, the CPU 31 intermittently outputs the infrared light, which is a function light, by driving the infrared light emission LED 5*d* (step 10). In this application example, the infrared light is intermittently output for about 0.5 msec at an interval of 5 msec. The projection position of the infrared light is substantially coincident with the projection position of the above-mentioned visible light.

In this state, the CPU 31 determines whether or not the game number select switch is turned on (step 11). If the player operates the game number select switch SW5, "YES" is determined, and 1 is added to the game number set counter (step 12). Next, the CPU 31 determines whether or not the value of the game number set counter is 7 (step 13). When the value of the game number set counter is 7, "YES" is determined, and the game number set counter is set to 1 (step 14).

In an ordinary tennis match, since a set with more than a six-game score is not played, the number of seven or more games is not set so when the number of games is seven, the counter is set to return to game number one.

If the game number set counter is not 7 at step 13, "NO" is determined, and without implementing the sequence of step 14, the value of the game number set counter is generated by a voice as the next sequence (step 15). Then, the decision of step 11 is repeated.

On the other hand, if "NO" is determined in the decision of step 11, next, whether or not level select switch is turned on is determined (step 16). If the level select switch SW6 is operated by the player, "YES" is determined, and 1 is added to the level set counter (step 17). The CPU 31 determines whether or not the value of the level set counter is 4 (step 18).

In the projection unit 1, the driving speed of the motor can be set at several settings. Levels 1, 2, and 3 are the references of the speed selection by the CPU 31. No level beyond those is set. Therefore, in case the speed is level 4, it is set to return to level 1.

In case the value of the level set counter is 4, "YES" is determined, and the level set counter is set to 1 (step 19), and in case the value of the level set counter is not 4, "NO" is determined. Then, without implementing the sequence of step 19, the value of the level set counter is generated by a voice as the next sequence (step 20).

On the other hand, if "NO" is determined in the decision of step 16, whether or not the infrared light is detected is determined (step 21).

If the player does not operate the reflection plane 10 of the racket 7 in accordance with the projection position of the above-mentioned light, no reflected function light (reflected infrared light) is generated, and the result of the decision (step 21) as to whether the function light is detected is "NO." Again, the sequence after step 11 is repeated.

As mentioned above, when lighting of the P1 LED 5*a* and projection of the light begin, if the player operates the game number select switch, the number of games of one match can be changed, and if the level select switch is operated, the level of the degree of difficulty of the game can be changed. In other words, with the repetition of the sequence of steps 11–20, the player can set the desired level and number of games.

With the fitting operation of the reflection plane of the racket to the projection position of the light by the player, the function light contacts the reflection plane 10 of the racket 7, and if the reflected function light (reflected infrared light) arrives at the function light sensor (infrared light sensor) SW2, the function light sensor SW2 generates the detected signal.

Figure 23:
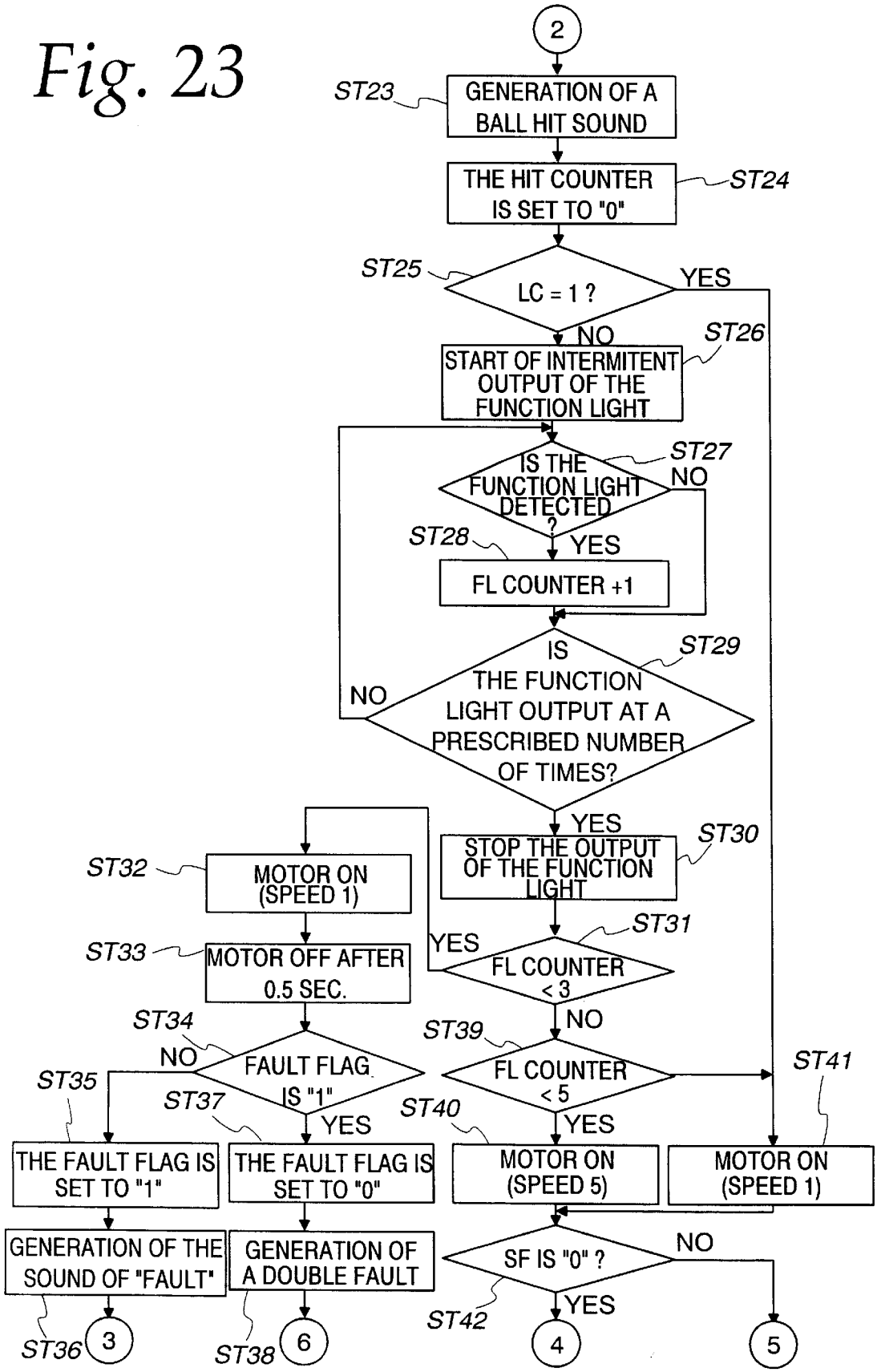
FIG. 23 is a flow chart showing the game sequence of the game device of FIG. 1.

If the detected signal is input, the CPU 31 determines "YES" in the decision (step 21) as to whether the function light is detected, stops the output of the function light (step 22), and starts a sequence similar to the serve in a tennis match as shown in FIG. 23.

First, a ball hit sound "pon" of the serve is generated (step 23), and a hit counter is set to 0 (step 24).

The hit counter is a counter that records continuously the hits of the rally in a game, and the CPU 31 increments the hit counter at steps 77 and 95, which will be mentioned later, and sets it to 0 at the above-mentioned step 24. The CPU 31 refers the value of the hit counter, as the speed is set at steps 75 and 93 which are a set processing the ball return speed, in the ball return sequence shown in FIGS. 26 and 30 that will be mentioned later.

Next, whether or not the value of the level counter is 1 is determined (step 25). If the decision result is "NO," an intermittent output of the function light is resumed (step 26). At step 26, similar to the above-mentioned step 10, the function light is also intermittently output for 0.5 msec at an interval of 5 msec.

Next, whether or not the function light is detected is determined (step 27). With the fitting operation of the reflection plane 10 of the racket to the projection position of the light by the player, the function light contacts the reflection plane 10 of the racket 7, and if the reflected function light (reflected infrared light) arrives at the function light sensor (infrared light sensor) SW2, the function light sensor SW2 generates the detected signal. If the detected signal from the function light sensor SW2 is input, the CPU 31 determines "YES" and adds 1 to the function light counter (step 28). If "NO" is determined, the function light counter is not incremented.

Next, the CPU 31 determines whether or not the function light has been output a prescribed number of times (in the present application example, 10 times) (step 29). If "NO" is determined, the sequence of steps 27 and 28 is repeated.

If the intermittent output of the function light occurrences reach a prescribed number of times, the CPU 31 stops the output of the function light.

The sequence of steps 21–30 is carried out in a very short time and is finished when the player throws the reflection plane of the racket once to the projection position of the light. This means that the player has finished the serve.

In other words, if the player throws the reflection plane of the racket to the projection position of the light, the reflected function light is generated, and the function light sensor generates the detected signal. If the signal is input into CPU 31, it stops the output of the function light. However, in case the player sets the level to numbers other than 1, it immediately resumes the output of the function light and intermittently outputs it 10 times. At that time, since the motor is not driven, the projection position of the visible light and the function light is not changed. As long as the racket position of the player is not changed, each time the reflected function light is generated and the function light sensor detects the reflected function light, the function light counter is incremented one by one, and the value of the function light counter will be 10 at maximum.

The value of the function light sensor is the reference in determining the change speed of the projection position of the light, that is, the rotation speed of the motor by the CPU 31, and in this case, the serve speed is determined by the value of the detection light counter.

FIG. 24 is a table showing the relationship among the level, value of the function light counter, and rotation speed (speed of a served ball) of the motor.

Since level 1 is the easiest level, no service fault is caused, and a fast service is not generated. The slowest service is always generated, and the speed is set to the slowest 1, regardless of the value of the function light counter.

At levels other than level 1, that is, at level 2 or 3, when the value of the function light sensor is 0–2, fault is set, and when the value of the function light counter is 3 or 4, the fastest speed 5 is set. When the value of the function light counter is 5 or more, the slowest speed 1 is set. Service faults, fast serves, and slow serves are thus generated.

Since the motor is stopped when the player serves a ball, the projection position of the function light is stopped. Therefore, if the player throws the reflection plane of the racket to the projection position and does not move it, the value of the function light counter easily becomes 5 or more.

If it is arranged so that the higher the value of the function light counter, the faster the speed, as mentioned above, a fast serve is always generated if the racket is not moved, which is not exciting. Therefore, it is arranged so that when the value of the function light counter is 4 or 5, the fastest speed can be generated. As a result, since the fastest serve is generated only when the player moves the racket well, the technical ability of the player is required to generate a fast serve and interest is increased.

The CPU 31 determines whether or not the value of the function light counter is smaller than 3 (step 31). If "YES" is determined, driving of the motor is started at speed 1 (step 32), and the motor is stopped after 0.5 sec (step 33). The fact that the value of the function light counter is smaller than 3 means that the player can contact the function light to the reflection plane of the racket only two times among the 10 outputs of the function light by shifting the position of the racket, so that the service fails.

The CPU 31 determines whether or not the fault flag is "1" (step 34). The fault flag is "0" or "1," and when the fault flag is "0," if the serve is a fault, the CPU sets the fault flag to "1." When the fault flag is "1," if a fault is generated, so that a double fault is generated, the fault flag is set to "0."

Therefore, if the decision result is "NO" in the decision of step 34, the fault flag is set to "1" (step 35), and a sound of "fault" is generated (step 36). Then, the flow is moved to the preparation sequence of a service shown in FIG. 25.

If the decision result is "YES" in the decision of step 34, the fault flag is set to "0" (step 37), and a sound of "double fault" is generated (step 38). Then, the flow is moved to the score sequence of the player 2 that is the second player or computer shown in FIG. 31.

On the other hand, the case where "NO" is determined in the decision of the above-mentioned step 31 is the case where the value of the function light counter is 3 or more. In this case, whether or not the value of the function light counter is less than 5 is then determined (step 39).

If the decision result is "YES," the motor is driven at the fastest speed 5 (step 40). If the decision result is "NO," the motor is driven at the slowest speed 1 (step 41).

If the decision result is "YES" at the above-mentioned step 25, the motor is driven at the slowest speed 1 without implementing the processing after the above-mentioned step 26 (step 41).

The CPU 31 determines whether or not the serve flag is "0" (step 42). In case the player 1 serves a ball and the serve flag is "0," "YES" is determined, and the flow proceeds to the return sequence of the second player or computer that is the player 2 shown in FIG. 26. In case the player 2 or computer serve a ball and the serve flag is "1," "NO" is determined, and the flow proceeds to the return sequence of the player 1 shown in FIG. 30.

Figure 25:
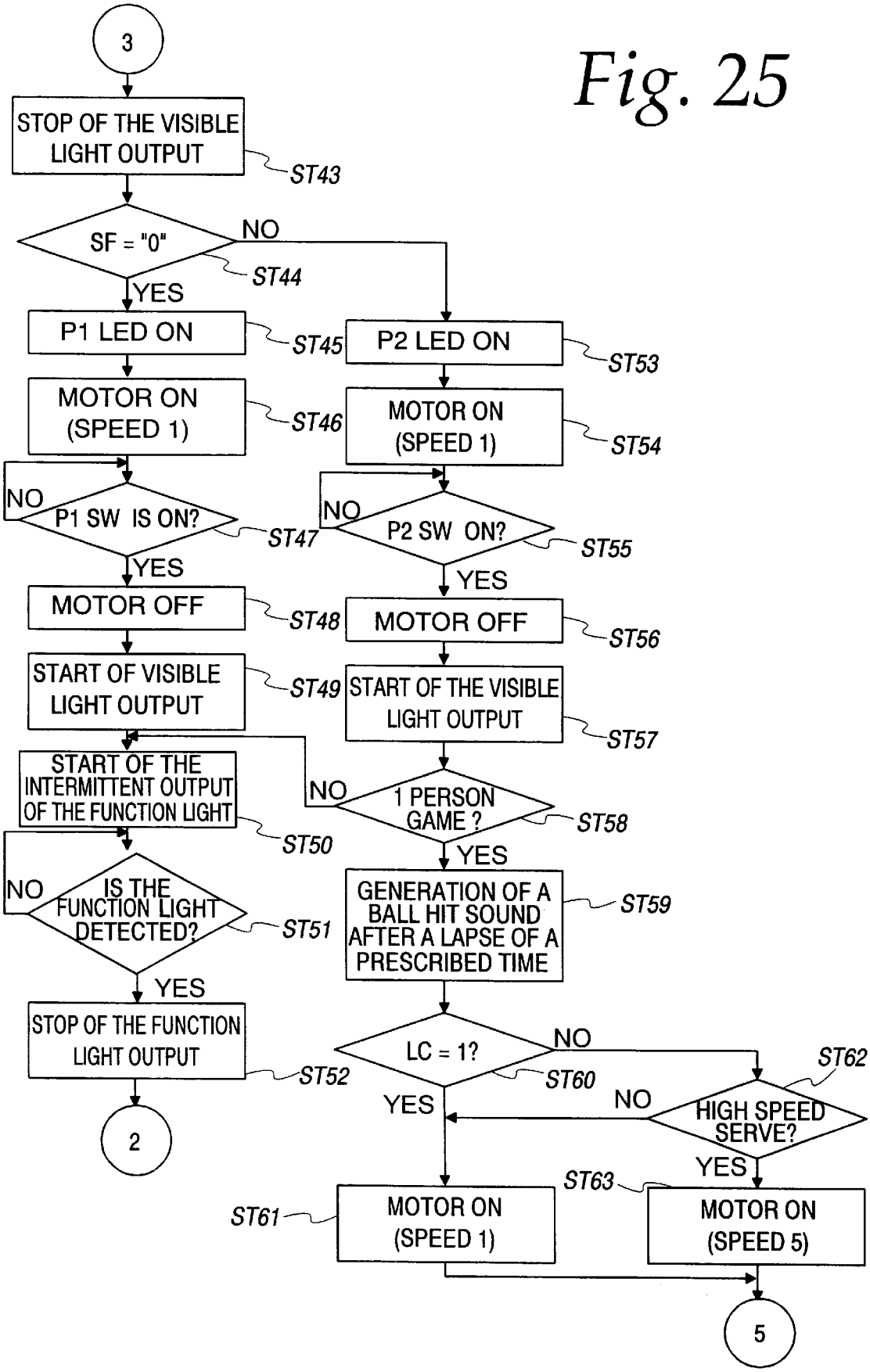
FIG. 25 is a flow chart showing the game sequence of the game device of FIG. 1.

Next, the sequence of the second serve after the generation of the sound of "fault" at the above-mentioned step 36 is explained based on FIG. 25.

The CPU 31 stops the output of the above-mentioned visible light (step 43) and determines whether or not the serve flag is "0" (step 44). When the serve flag is "0," "YES" is determined, and the player 1 LED is lit (step 45). Next, the motor is driven at speed 1, and whether or not the player 1 switch SW3 is turned on is determined (step 47). If "YES" is determined, the motor is stopped (step 48).

Then, the output of the visible light is started (step 49), and the output of the function light (infrared light) is also started (step 50). In this case, the output of the function light is also an intermittent output similar to the above-mentioned step 10. Similarly to the above-mentioned step 21, whether or not the function light is detected is determined (step 51), and if "YES" is determined, the output of the function light is stopped (step 52). Then, a sequence similar to the serve in the tennis match shown in FIG. 23 is repeated.

In case the decision result is "NO" in the decision as to whether or not the serve flag of step 44 is "0," the player 2 or computer has the serve, and the player 2 LED is lit (step 53).

The motor is driven at speed 1 (step 54), and whether or not the player 2 switch SW4 is turned on is determined (step 55).

If the decision result of step 55 is "YES," the motor is stopped (step 56), and the output of the visible light is started (step 57). Whether or not the game is a one-person game is determined (step 58).

If the decision result is "NO," the game is a two-person game in which the game is played by two players, and since the second player serves the ball, the serve sequence of the player after the above-mentioned step 50 is implemented.

If the decision result is "YES," the game is a one-person game in which one player plays the game with the computer, and a serve sound caused by hitting a ball is generated after a prescribed time (1 sec in this application example) (step 59). Then, whether or not the level is 1 is determined (step 60).

Figure 30:
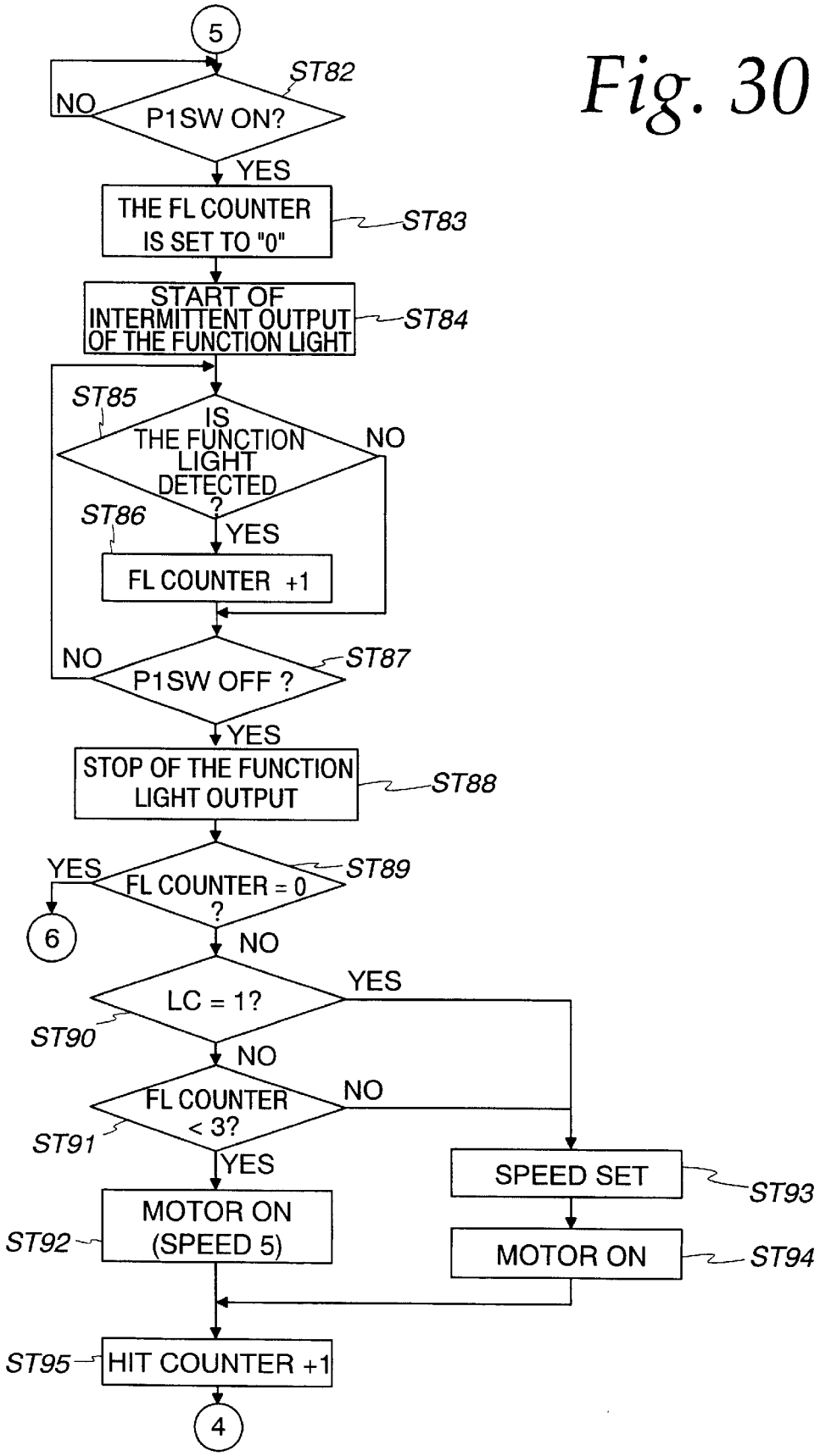
FIG. 30 is a flow chart showing the game sequence of the game device of FIG. 1.

If the decision result is "YES" and the level is 1, the motor is driven at speed 1 (step 61), and if the decision result is "NO" and the level is 2 or 3, whether or not a high-speed serve will be generated by a random number sampling is determined (step 62). If the decision result is "NO," the motor is driven at speed 1 (step 61), and in the case of "NO," "YES," the motor is driven at speed 5 (step 63). Then, the ball return sequence of the player 1 shown in FIG. 30 is implemented.

Figure 26:
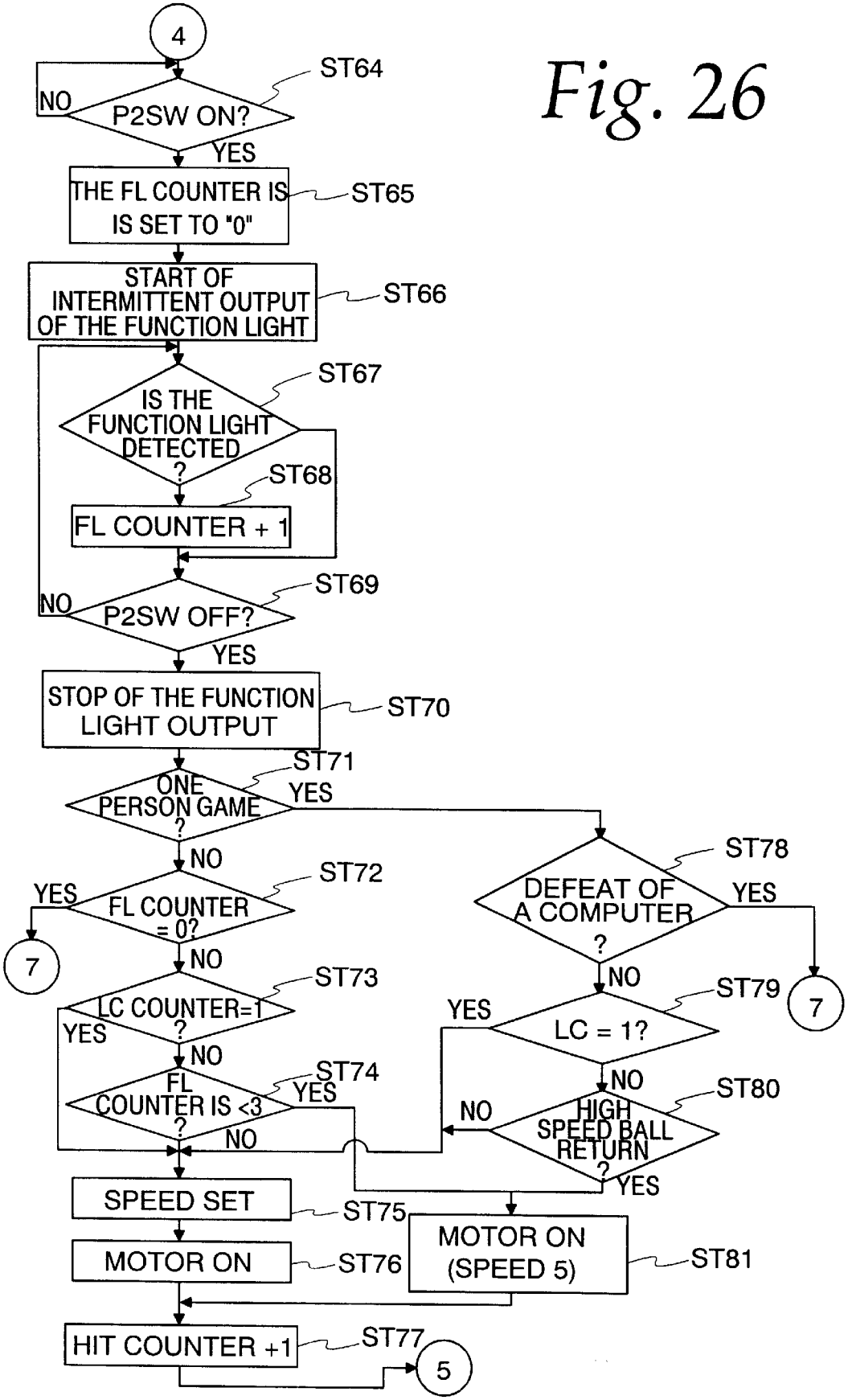
FIG. 26 is a flow chart showing the game sequence of the game device of FIG. 1.

Next, the sequence in which the first player as the player 1 succeeds in serving and the second player or computer as the player 2 returns the ball is explained based on FIG. 26.

The CPU 31 determines whether or not the player 2 switch SW4 is turned on (step 64). If the decision result is "YES," the value of the function light counter is set to 0 (step 65), and an intermittent output of the function light is started (step 66). At step 66, similar to the above-mentioned step 10, the function light is also intermittently output for 0.5 msec at an interval of 5 msec.

Next, whether or not the function light is detected is determined (step 67). With the fitting operation of the reflection plane of the racket to the projection position of the light by the player 2 as a game player, if the function light contacts the reflection plane of the racket and the reflected function light (reflected infrared light) arrives at the function light sensor (infrared light sensor) SW2, the function light sensor SW2 generates the detection signal. If the detected signal from the function light sensor SW2 is input, the CPU 31 determines "YES" and adds 1 to the function light counter (step 68). If "NO" is determined, the function light counter is not incremented.

When the player 2 switch SW4 is turned on, the CPU 31 repeats the above-mentioned sequence steps 67 and 68, and if the player 2 switch SW4 is turned off, "YES" is determined in the decision as to whether or not the player 2 switch of step 69 is turned off. Then, the output of the function light is stopped (step 70).

Next, the CPU 31 determines whether or not the game is a one-person game (step 71), and if "NO" is determined, that is, if the game is a two-person game, whether or not the value of the function light counter is 0 is determined (step 72).

As shown in Table II of FIG. 27, the kind of ball return is preset by the value of the function light counter.

Figure 32:
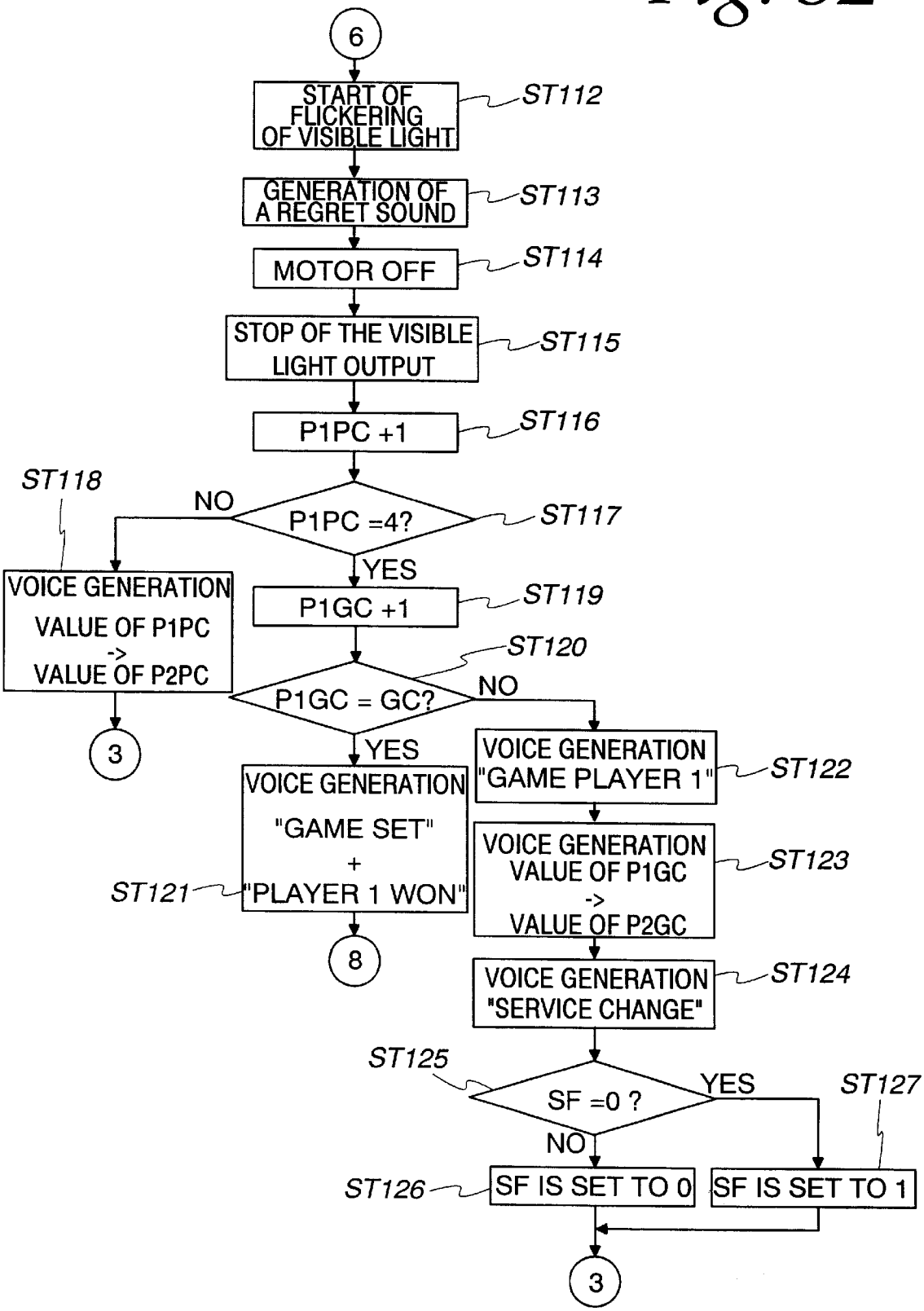
FIG. 32 is a flow chart showing the game sequence of the game device of FIG. 1.

If the value of the function light counter is 0 and the decision result is "YES," the game player, who is the player 2, cannot fit the reflection plane of the racket to the projection position of the function light and fails to return the ball. Therefore, the game player, who is the player 1, scores a point, and the sequence of the player 1 score shown in FIG. 32 is implemented.

If the decision result is "NO," the game player, who is the player 2, can fit the reflection plane of the racket to the projection position of the function light, and the function light sensor SW2 detects the reflected function light. The CPU 31 determines whether or not the level is 1 (step 73), and if the level is 2 or 3 and the decision result "NO," whether or not the value of the function light counter is less than 3, that is, 1 or 2, is determined (step 74). If the result is "NO," speed set processing, which will be explained later, is implemented (step 75), and if the decision result of the above-mentioned step 73 is "YES," that is, in the case of level 1, speed set processing is implemented without the decision of step 74 (step 75). Then, driving of the motor is started at a set speed (step 76), and the hit counter is incremented by 1 (step 77).

On the other hand, if the decision result is "YES" in the decision of the above-mentioned step 74, that is, if the value of the function light counter is 1 or 2, driving of the motor is started at speed 5 without implementing speed set processing (step 81), and the hit counter is incremented by 1 (step 77). Then, the ball return sequence of the player 1 shown in FIG. 30 is implemented.

Figure 29:
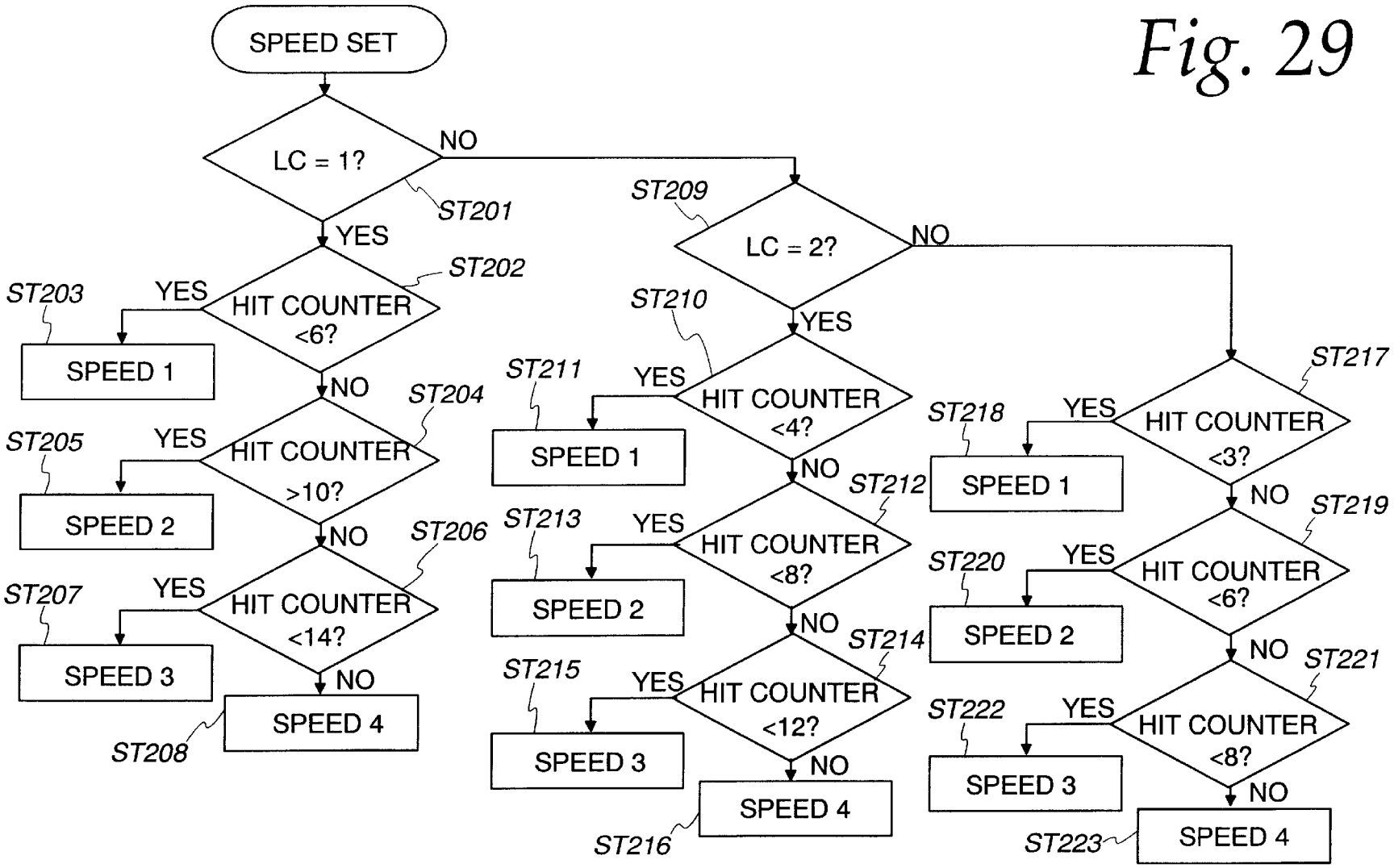
FIG. 29 is a flow chart showing the sequence of speed set processing.

Next, the speed set processing of step 75 and step 93, which will be mentioned later, is explained based on Table III shown in FIG. 28 and a flow chart shown in FIG. 29.

The ball return speed is preset in accordance with the level and the value of the hit counter as shown in Table III.

First, the CPU 31 determines whether or not the level is 1 (step 201). If "YES," whether or not the hit counter is less than 6 is determined (step 202). If the decision result is "YES," speed 1 is set (step 203). If the decision result is "NO," whether or not the hit counter is less than 10 is determined (step 204). If the decision result is "YES," speed 2 is set (step 205). If the decision result is "NO," whether or not the hit counter is less than 14 is determined (step 206). If the decision result is "YES," speed 3 is set (step 207). If the decision result is "NO," speed 4 is set (step 208).

If the level is not 1 in the decision of the above-mentioned step 201 and the decision result is "NO," whether or not the level is 2 is determined (step 209). If the decision result is "YES," whether or not the hit counter is less than 4 is determined (step 210). If the decision result is "YES," speed 1 is set (step 211). If the decision result is "NO," whether or not the hit counter is less than 8 is determined (step 212). If the decision result is "YES," speed 2 is set (step 213). If the decision result is "NO," whether or not the hit counter is less than 12 is determined (step 214). If the decision result is "YES," speed 3 is set (step 215). If the decision result is "NO," speed 4 is set (step 216).

If the level is not 2 in the decision of the above-mentioned step 209 and the decision result is "NO," the level is 3. Whether or not the hit counter is less than 3 is determined (step 217). If the decision result is "YES," speed 1 is set (step 218). If the decision result is "NO," whether or not the hit counter is less than 6 is determined (step 219). If the decision result is "YES," speed 2 is set (step 220). If the decision result is "NO," whether or not the hit counter is less than 8 is determined (step 221). If the decision result is "YES," speed 3 is set (step 222). If the decision result is "NO," speed 4 is set (step 223).

As mentioned above, the higher the value of the hit counter, that is, the larger the rally hits, the faster the ball return speed, and the higher the level, the more rapid the increase of the speed corresponding to the value of the hit counter. Since promptness is required in the racket operation of the player with increase of the ball return speed, it becomes difficult for the player to strike back the projection of the light from the ball return.

The case where the decision result is "YES" in the decision as to whether or not the game is a one-person game at step 71 is the case where the computer returns the ball. Therefore, the function light counter is not incremented.

In case the computer returns the ball, the CPU 31 determines whether or not the computer loses by random number sampling (step 78), and if "YES," the score sequence of the player 1 shown in FIG. 32 is implemented.

In case "NO" is determined in the decision of step 78, whether or not the level is 1 is determined (step 79), and if "YES," the sequence after the speed setting of the above-mentioned step 75 is implemented. If the level is 2 or 3 and the decision result of step 79 is "NO," the CPU 31 determines whether or not the ball is returned at high speed by random number sampling (step 80), and if "NO," the sequence after the speed setting of the above-mentioned step 75 is implemented. If "YES," the motor is driven at speed 5 in the above-mentioned step 81, and the hit counter is incremented by 1 (step 77). Then, the ball return sequence of the player 1 shown in FIG. 30 is implemented.

Next, the return sequence of the player 1 is explained based on the flow chart of FIG. 30.

The CPU 31 determines whether or not the player 1 switch SW3 is turned on (step 82). If the decision result is "YES," the value of the function light counter is set to 0 (step 83), and an intermittent output of the function light is started (step 84). At step 84, similar to the above-mentioned step 10, the function light is also intermittently output for 0.5 msec at an interval of 5 msec.

Next, whether or not the function light is detected is determined (step 85). With the fitting operation of the reflection plane of the racket to the projection position of the light by the player 1 who is a game player, if the function light contacts the reflection plane of the racket and the reflected function light (reflected infrared light) arrives at the function light sensor (infrared light sensor) SW2, the function light sensor SW2 generates the detection signal. If the detected signal from the function light sensor SW2 is input, the CPU 31 determines "YES" and increments the function light counter by 1 (step 86). If "NO" is determined, the function light counter is not incremented.

While the player 1 switch SW is turned on, the CPU 31 repeats the above-mentioned sequence steps 85 and 86, and if the player 1 switch SW3 is turned off, "YES" is determined in the decision as to whether or not the player 1 switch of step 87 is turned off. Then, the output of the function light is stopped (step 88).

Next, the CPU 31 determines whether or not the value of the function light counter is 0 (step 89).

If the value of the function light counter is 0 and the decision result is "YES," the game player, who is the player 1, cannot fit the reflection plane of the racket to the projection position of the function light and fails to return the ball. Therefore, the game player, who is the player 2, or computer scores a point, and the score sequence of the player 2 shown in FIG. 31 is implemented.

The case where the decision result is "NO" is the case where the game player, who is the player 1, can fit the reflection plane of the racket to the projection position of the function light and the function light sensor SW2 detects the reflected function light. The CPU 31 determines whether or not the level is 1 (step 90), and if the level is 2 or 3 and the decision result is "NO," whether or not the value of the function light counter is less than 3, that is, 1 or 2, is determined (step 91). If the result is "NO," speed set processing, which has already been explained, is implemented (step 93), and if the decision result of step 90 is "YES," that is, level 1, speed set processing is implemented without the decision of step 91 (step 93). Then, driving of the motor is started at a set speed (step 94), and the hit counter is incremented by 1 (step 95).

On the other hand, if the decision result is "YES" in the decision of the above-mentioned step 91, that is, if the value of the function light counter is 1 or 2, driving of the motor is started at speed 5 without speed set processing (step 92), and the hit counter is incremented by 1 (step 95). Then, the return sequence of the player 2 (the second game player or computer) shown in FIG. 26, which has already been explained, is implemented.

Figure 31:
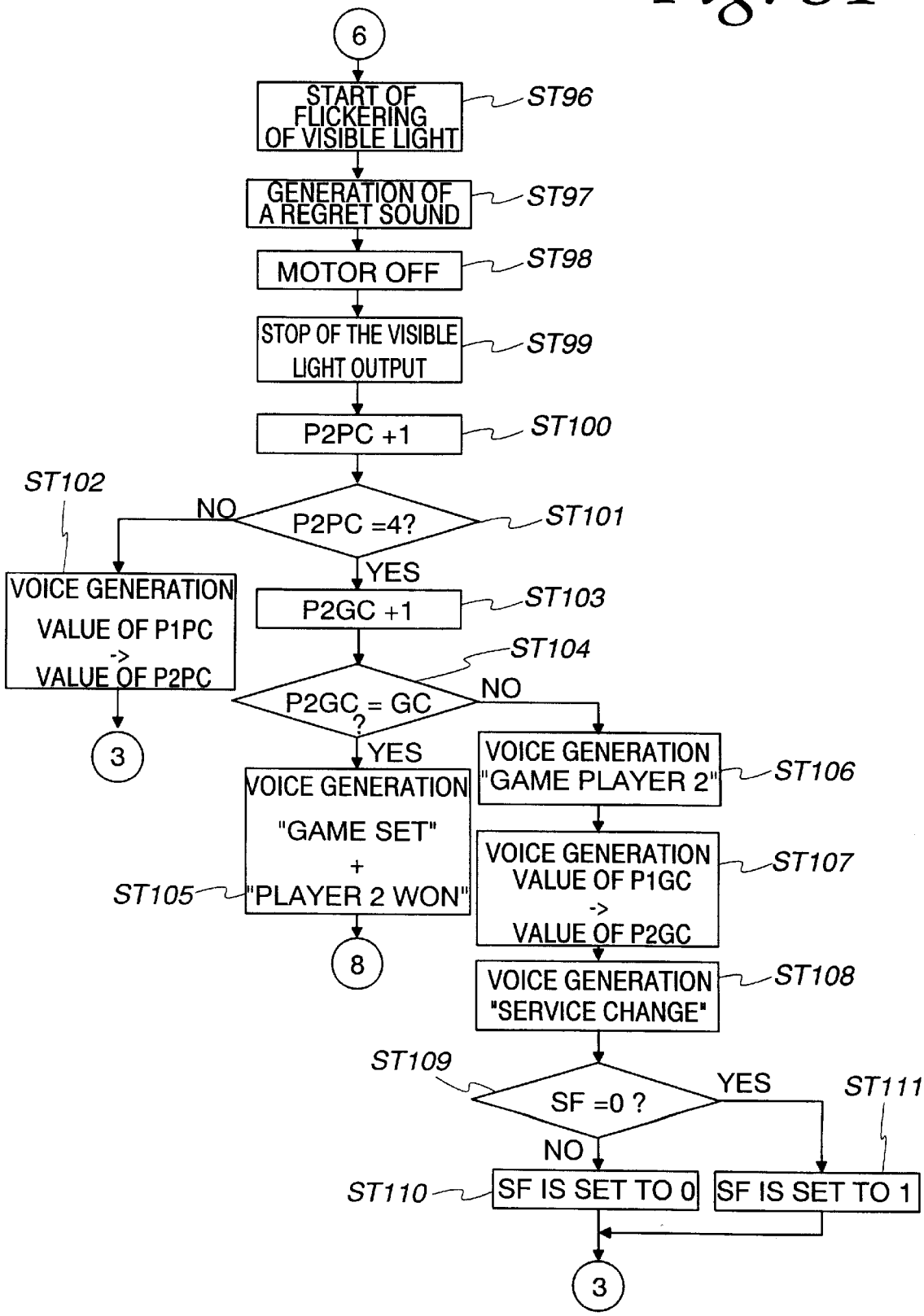
FIG. 31 is a flow chart showing the game sequence of the game device of FIG. 1.

Next, the score sequence of the second game player, who is the player 2, or computer is explained based on FIG. 31.

The CPU 31 flickers a visible light output (step 96), generates a regret sound (step 97), stops the motor (step 98), and also stops the output of the visible light (step 99).

The CPU 31 increments the player 2 score counter (P2PC) by 1 (step 100) and determines whether or not the player 2 score counter is 4 (step 101).

In this application example, since the setting of the game score is the same as that of a tennis match, if four points are scored, a game is won, and if the number of games set at steps 12–14 is attained, a match is won.

If the decision result is "NO," since the score does not equal one game won, a sound similar to that for a tennis match is generated for the score of player 1 and the score of player 2 to announce the score attained by the game players (step 102). Then, the flow proceeds to the preparation sequence for serve shown in FIG. 25.

The case where the decision result is "YES" in the decision of step 101 is the case where the score reaches game, and the CPU 31 increments the player 2 games won counter (P2GC) by 1 (step 103).

Next, whether or not the value of the player 2 games won counter is the same as the value of the game number set counter (GC) is determined (step 104). Since the case where the decision result is "YES" is the case where the player 2 wins the match, the sound of "game set" and "player 2 won" is generated (step 105). Then, the flow proceeds to the start sequence of a new match at step 3.

If the decision result of step 104 is "NO," a sound of "game player 2" is generated (step 106). Since the number of games won does not equal one match won, a sound similar to that of a tennis match is generated for the number of games won by the player 1 and the number of games won by the player 2 to announce the number of games attained by the players (step 107). Then, a sound of "service change" is generated (step 108), and whether or not the serve flag is "0" is determined (step 109). If "NO," the serve flag is set to "0" (step 110), and if "YES," the serve flag is set to "1" (step 111). Then, the flow proceeds to the preparation sequence for serve shown in FIG. 25.

Next, the score sequence of the first game player, who is the player 1, is explained based on FIG. 32.

The CPU 31 flickers a visible light output (step 112), generates a regret sound (step 113), stops the motor (step 114), and also stops the output of visible light (step 115).

The CPU 31 increments the player 1 score counter (P1PC) by 1 (step 116) and determines whether or not the player 1 score counter is 4 (step 117).

If the decision result is "NO," since the score does not equal one game won, a sound similar to that of a tennis match is generated for the score of player 1 and the score of player 2 to announce the score attained by the players (step 118). Then, the flow proceeds to the preparation sequence for serve shown in FIG. D25 [sic; 25].

The case where the decision result is "YES" in the decision of step 117 is the case where the score reaches game, and the CPU 31 increments the player 1 games won counter (PLGC) by 1 (step 119).

Next, whether or not the value of the player 1 games won counter is the same as the value of the game number set counter (GC) is determined (step 120). Since the case where the decision result is "YES" is the case where the player 1 wins the match, sounds of "game set" and "player 1 won" are generated (step 121). Then, the flow proceeds to the start sequence of a new match at step 3.

If the decision result of step 120 is "NO," a sound of "game player 1" is generated (step 122). Since the number of games won has not reached the number required to win the match, a sound similar to that of a tennis match is generated for the number of games won by player 1 and the number of games won by player 2 to announce the number of games attained by the players (step 123). Then, a sound of "service change" is generated (step 124), and whether or not the serve flag is "0" is determined (step 125). If "NO," the serve flag is set to "0" (step 126), and if "YES," the serve flag is set to "1" (step 127). Then, the flow proceeds to the preparation sequence for serve shown in FIG. 25.

As mentioned above, since the game device of the present invention projects a light reciprocating back and forth and also projects a function light at the projection position of the light, the function light can be reflected by throwing the reflection plane of a racket to the projection position of the light by a game player.

If the function light detection means detects the reflected function light and generates a signal, since a control means varies the change speed of the projecting direction in accordance with the amount of signal generated, it is not simple for the game player to throw the reflection plane of the racket to the projection position of the light. Therefore, the game player can play a game of studying methods for moving the racket by chasing the projection of the light.

In the game device of the application example, the game player selects the projection of the light with the second game player, who is an opponent, or with a computer as a tennis ball, so that a rally similar to a tennis match is possible. At the same time, since a counter, which increments the score of the opponent assuming that the ball reception fails when the signal from the function light detection means is not generated in a prescribed amount, is installed, a competitive game with victory and defeat can be played.

Furthermore, since sound effects, sounds for reporting game status, and sounds from an umpire are timely generated, a feeling can be obtained as though a game such as tennis or table tennis were actually being played by moving the racket along with the movement of the lights.

Also, since the images of lights are exchanged with each other instead of a ball, it is not necessary to pick up a ball that is missed so the game can be played similarly to an actual game of tennis but in a limited place.

What is claimed is:

1. An electronic game for simulating playing of a conventional ball impacting game, the electronic game comprising:

a signal transmitter for emitting signals representative of an incoming path of a ball relative to a player;

a signal receiver for sensing signals representative of an outgoing path of a ball relative to a player;

a housing of the signal transmitter;

control circuitry for causing the signal transmitter to emit signals and for processing the signals sensed by the signed receiver;

an actuator mechanism for shifting the housing via the control circuitry to change locations of the emitted signals from the signal transmitter, wherein the actuator mechanism pivots and translates the housing in a plurality of directions for varying the location of the emitted signal to provide a realistic game play experience; and a player manipulated implement to be moved by the player to the general location of the emitted signal for causing a signal to be transmitted to the signal receiver for continuing game play.

2. The electronic game of claim 1 wherein the signal transmitter includes a visible light source and an IR emitter for emitting IR signals, and the signal receiver includes an IR detector for detecting IR signals, and a reflective surface of the player manipulated implement for being moved into the path of light from the visible light source for causing IR signals from the IR emitter to be reflected to the IR detector.

3. The electronic game of claim 2 including a playing surface onto which the visible light source projects an image of a ball with shifting of the housing causing the image to move about the surface.

4. The electronic game of claim 1 including a switch for selecting one of a one-person game with the control circuitry generating a simulated opponent, and a two-person game with a second player responding to emitted signals from the transmitter that are generated by the control circuitry in response to movements of the player manipulated implement which cause signals to be sensed by the signal receiver.

5. The electronic game of claim 1 wherein the actuator mechanism includes a variable speed drive system whose speed is determined by the control circuitry, and a level select switch for allowing selections of different levels of game play difficulty with the actuator mechanism shifting the housing and signal transmitter therein via the drive system from slow speeds to faster speeds at higher rates at higher game play levels as game play continues.

6. The electronic game of claim 5 wherein the control circuitry includes a hit counter that is incremented each time the drive speed is determined by the control circuitry with the drive speed being predetermined based on the selected level of game play difficulty and the value of the hit counter.

7. The electronic game of claim 1 wherein the control circuitry includes a detection counter that is incremented each time a signal is sensed by the signal receiver while the signals from the signal transmitter are being transmitted toward a single general location and the actuator mechanism includes a variable speed drive system whose speed is determined by the control circuitry, and an optimum range for the value of the detection counter so that the control circuitry generates high speeds for the drive system with values outside the optimum range causing the causing the control circuitry to generate lower speeds for the drive system or to register a point for an opponent.

8. The electronic game of claim 7 wherein the values outside the optimum range include values of one or more sensed signals and values higher than the greatest number of sensed signals in the optimum range.

* * * * *